US012389983B2

(12) United States Patent
Page

(10) Patent No.: US 12,389,983 B2
(45) Date of Patent: Aug. 19, 2025

(54) SOLE STRUCTURE FOR AN ARTICLE OF FOOTWEAR

(71) Applicant: NIKE, Inc., Beaverton, OR (US)

(72) Inventor: Christopher J. Page, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 26 days.

(21) Appl. No.: 18/338,461

(22) Filed: Jun. 21, 2023

(65) Prior Publication Data

US 2023/0329394 A1 Oct. 19, 2023

Related U.S. Application Data

(63) Continuation of application No. 16/952,126, filed on Nov. 19, 2020, now Pat. No. 11,723,431.

(60) Provisional application No. 62/937,419, filed on Nov. 19, 2019.

(51) Int. Cl.
*A43B 13/20* (2006.01)
*A43B 13/12* (2006.01)

(52) U.S. Cl.
CPC ..... *A43B 13/20* (2013.01); *A43B 13/122* (2013.01); *A43B 13/127* (2013.01)

(58) Field of Classification Search
None
See application file for complete search history.

(56) References Cited

U.S. PATENT DOCUMENTS 2,100,492 A 11/1937 Sindler
2,762,134 A * 9/1956 Town ..... A43B 17/03 36/153
3,469,576 A * 9/1969 Everts ..... A43B 17/03 36/154
3,568,227 A * 3/1971 Dunham ..... A47C 27/087 5/644

(Continued)

FOREIGN PATENT DOCUMENTS

CN 101179957 A 5/2008
CN 103517649 A 1/2014

(Continued)

OTHER PUBLICATIONS

USPTO, Non-Final Office Action for U.S. Appl. No. 16/952,126, mailed Aug. 12, 2022.

(Continued)

*Primary Examiner* — Jila M Mohandesi
(74) *Attorney, Agent, or Firm* — Honigman LLP; Matthew H. Szalach; Jonathan P. O'Brien

(57) ABSTRACT

A sole structure for an article of footwear includes a midsole having a top surface and a bottom surface opposite the top surface, the bottom surface including a first recess. A first bladder is disposed within the first recess and a first outsole member is coupled to the midsole and includes a ground-engaging surface having a first traction element and a second traction element. The first traction element is aligned with the first bladder and defines a first height relative to the ground-engaging surface, the second traction element is aligned with the first bladder and defines a second height relative to the ground-engaging surface, the second height being greater than the first height.

20 Claims, 14 Drawing Sheets

(56) References Cited

U.S. PATENT DOCUMENTS

| | | | | |
|---|---|---|---|---|
| 5,313,717 | A * | 5/1994 | Allen | A43B 13/20 36/35 B |
| 6,354,020 | B1 * | 3/2002 | Kimball | A43B 13/203 36/35 B |
| 7,128,796 | B2 | 10/2006 | Hensley | |
| 7,707,745 | B2 | 5/2010 | Schindler | |
| 7,930,839 | B2 | 4/2011 | Litchfield | |
| 8,178,022 | B2 | 5/2012 | Schindler | |
| 8,863,408 | B2 | 10/2014 | Schindler et al. | |
| 8,881,431 | B2 | 11/2014 | Sink | |
| 9,687,044 | B2 | 6/2017 | Schindler | |
| 10,016,015 | B2 * | 7/2018 | Ellis, III | A43B 7/144 |
| 10,238,175 | B2 * | 3/2019 | Campos, II | A43B 13/125 |
| 10,548,370 | B2 | 2/2020 | Walsh | |
| 10,758,004 | B2 * | 9/2020 | Case | B32B 5/18 |
| 2003/0101619 | A1 * | 6/2003 | Litchfield | A43B 13/203 36/29 |
| 2003/0183324 | A1 * | 10/2003 | Tawney | A43B 13/20 156/289 |
| 2007/0294916 | A1 * | 12/2007 | Park | A43B 13/206 36/35 B |
| 2008/0163512 | A1 * | 7/2008 | Hazenberg | A43B 21/285 36/28 |
| 2009/0090025 | A1 | 4/2009 | Cassiday | |
| 2012/0102783 | A1 | 5/2012 | Swigart et al. | |
| 2013/0192087 | A1 * | 8/2013 | Litchfield | A43B 13/203 36/43 |
| 2014/0215849 | A1 * | 8/2014 | Litchfield | A43B 13/145 36/28 |
| 2016/0295967 | A1 * | 10/2016 | Campos, II | A43B 13/20 |
| 2017/0119095 | A1 | 5/2017 | Greene | |
| 2018/0020771 | A1 * | 1/2018 | Lo | A43B 13/203 36/29 |
| 2018/0289108 | A1 | 10/2018 | Hoffer | |

FOREIGN PATENT DOCUMENTS

| | | | |
|---|---|---|---|
| CN | 205963062 | U | 2/2017 |
| CN | 108271343 | A | 7/2018 |
| KR | 101752984 | B1 | 7/2017 |
| WO | WO-2017/079256 | A1 | 5/2017 |
| WO | WO-2019118533 | A1 | 6/2019 |

OTHER PUBLICATIONS

European Patent Office (ISA), International Search Report and Written Opinion for App. No. PCT/US2020/061180, mailed Feb. 25, 2021.

USPTO, Final Office Action for U.S. Appl. No. 16/952,126, mailed Dec. 15, 2022.

USPTO, Notice of Allowance for U.S. Appl. No. 16/952,126, mailed Mar. 22, 2023.

The State Intellectual Property Office of PRC, Office Action for CN App. No. 202080092875.2, mailed Jul. 31, 2024.

Korea Intellectual Property Office, Office Action for KR App. No. 10-2022-7020565, mailed Mar. 14, 2024.

* cited by examiner

SOLE STRUCTURE FOR AN ARTICLE OF FOOTWEAR

CROSS REFERENCE TO RELATED APPLICATION

This application claims priority to U.S. application Ser. No. 16/952,126, filed Nov. 19, 2020, which claims priority to U.S. Provisional Application No. 62/937,419, filed Nov. 19, 2019, the contents of which are hereby incorporated by reference in their entireties.

FIELD

The present disclosure relates generally to a sole structure for an article of footwear, and more particularly to a sole structure including an outsole having a chamber-engaging member.

BACKGROUND

This section provides background information related to the present disclosure and is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures generally include a layered arrangement extending between a ground surface and the upper. One layer of the sole structure includes an outsole that provides abrasion-resistance and traction with the ground surface. The outsole may be formed from rubber or other materials that impart durability and wear-resistance, as well as enhance traction with the ground surface. Another layer of the sole structure includes a midsole disposed between the outsole and the upper. The midsole provides cushioning for the foot and may be partially formed from a polymer foam material that compresses resiliently under an applied load to cushion the foot by attenuating ground-reaction forces. The midsole may additionally or alternatively incorporate a fluid-filled bladder to provide cushioning to the foot by compressing resiliently under an applied load to attenuate ground-reaction forces. Sole structures may also include a comfort-enhancing insole or sockliner located within a void proximate to the bottom portion of the upper and a strobel attached to the upper and disposed between the midsole and the insole or sockliner.

Midsoles employing fluid-filled bladders typically include a recess sized and shaped to receive a similarly sized and shaped fluid-filled bladder. The fluid-filled bladders are often constructed to both flex and provide support when compressed resiliently under applied loads, such as during athletic movements. In this regard, fluid-filled bladders are often designed to balance support for the foot with cushioning characteristics that provide responsiveness as the bladder resiliently compresses under an applied load.

DRAWINGS

The drawings described herein are for illustrative purposes only of selected configurations and are not intended to limit the scope of the present disclosure.

Corresponding reference numerals indicate corresponding parts throughout the drawings.

DETAILED DESCRIPTION

Figure 1:
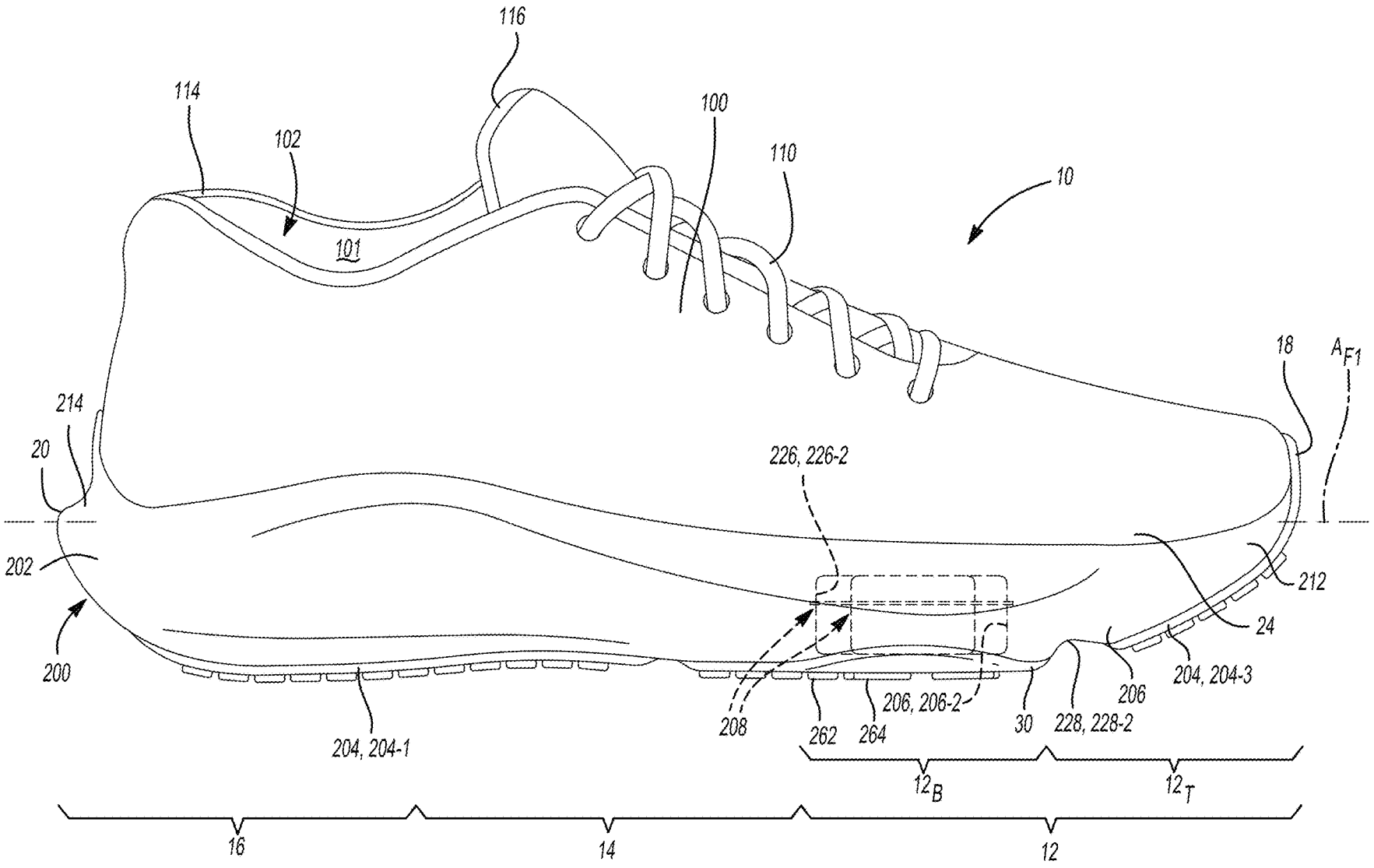
FIG. 1 is a side elevation view of an article of footwear in accordance with principles of the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

In one configuration, a sole structure for an article of footwear includes a midsole having a top surface and a bottom surface opposite the top surface, the bottom surface including a first recess. A first bladder is disposed within the first recess and a first outsole member is coupled to the midsole and includes a ground-engaging surface having a first traction element and a second traction element. The first traction element is aligned with the first bladder and defines a first height relative to the ground-engaging surface, the second traction element is aligned with the first bladder and defines a second height relative to the ground-engaging surface, the second height being greater than the first height.

The sole structure may additionally include one or more of the following optional features. Namely, the first outsole member may include at least one protrusion engaging the first bladder where at least a portion of the at least one protrusion is disposed within the first recess. Further, the at least one protrusion may include a first protrusion that is aligned with the second traction element.

In one configuration, (i) the first outsole member may include an upper surface facing the first bladder, (ii) the first recess may define a first depth extending in a direction perpendicular to the upper surface, and (iii) the first bladder may define a third height extending in a direction perpendicular to the upper surface, the third height being less than or equal to the first depth.

The first outsole member may include an upper surface facing the first bladder, whereby the upper surface is spaced apart from the first bladder. The upper surface may extend across the first recess. Further, (i) the second traction element may include a second size and shape and (ii) the ground-engaging surface may include a third traction element having a third size and shape, the second size and shape being the same as the third size and shape.

In one configuration, the bottom surface may include a second recess having a second bladder disposed therein. A second outsole member may be coupled to the midsole and may include at least one protrusion engaging the second bladder. The first recess and the second recess may be disposed along a line extending parallel to a lateral axis of the sole structure.

In another configuration, a sole structure for an article of footwear includes a midsole having a top surface and a bottom surface opposite the top surface, the bottom surface including a first recess. A first bladder is disposed within the first recess and a first outsole member is coupled to the midsole and includes a ground-engaging surface having a plurality of first traction elements and a plurality of second traction elements. The plurality of first traction elements each include a first distal end offset from the ground-engaging surface and disposed in a first plane. The plurality of second traction elements each include a second distal end offset from the ground-engaging surface and disposed in a second plane with the first plane being offset from the second plane.

The sole structure may include one or more of the following optional features. For example, the first outsole member may include at least one protrusion engaging the first bladder. At least a portion of the at least one protrusion may be disposed within the first recess.

In one configuration, (i) the first outsole member may include an upper surface facing the first bladder, (ii) the first recess may define a first depth extending in a direction perpendicular to the first upper surface, and (iii) the first bladder may define a first height extending in a direction perpendicular to the first upper surface, the first height being less than or equal to the first depth. The first upper surface may extend across the first recess.

In one configuration, the first outsole member may include a ground-engaging surface having a first traction element aligned with the first recess. Further, (i) the first traction element may include a first size and shape and (ii) the first outsole member may include a first protrusion engaging the first bladder and having a second size and shape, the first size and shape being the same as the second size and shape. The first traction element may be aligned with the first protrusion.

The bottom surface may include a second recess and a second bladder disposed within the second recess. A second outsole member having a second upper surface may be coupled to the midsole, the second upper surface facing, and spaced apart from, the second bladder. The first recess and the second recess may be disposed along a line extending parallel to a lateral axis of the sole structure.

Referring to FIG. 1, an article of footwear 10 includes an upper 100 and a sole structure 200. The article of footwear 10 may be divided into one or more regions. The regions may include a forefoot region 12, a mid-foot region 14, and a heel region 16. The forefoot region 12 may be subdivided into a toe portion 12T corresponding with phalanges, and a ball portion 12B associated with metatarsal bones of a foot. The mid-foot region 14 may correspond with an arch area of the foot, and the heel region 16 may correspond with rear portions of the foot, including a calcaneus bone.

Figure 2:
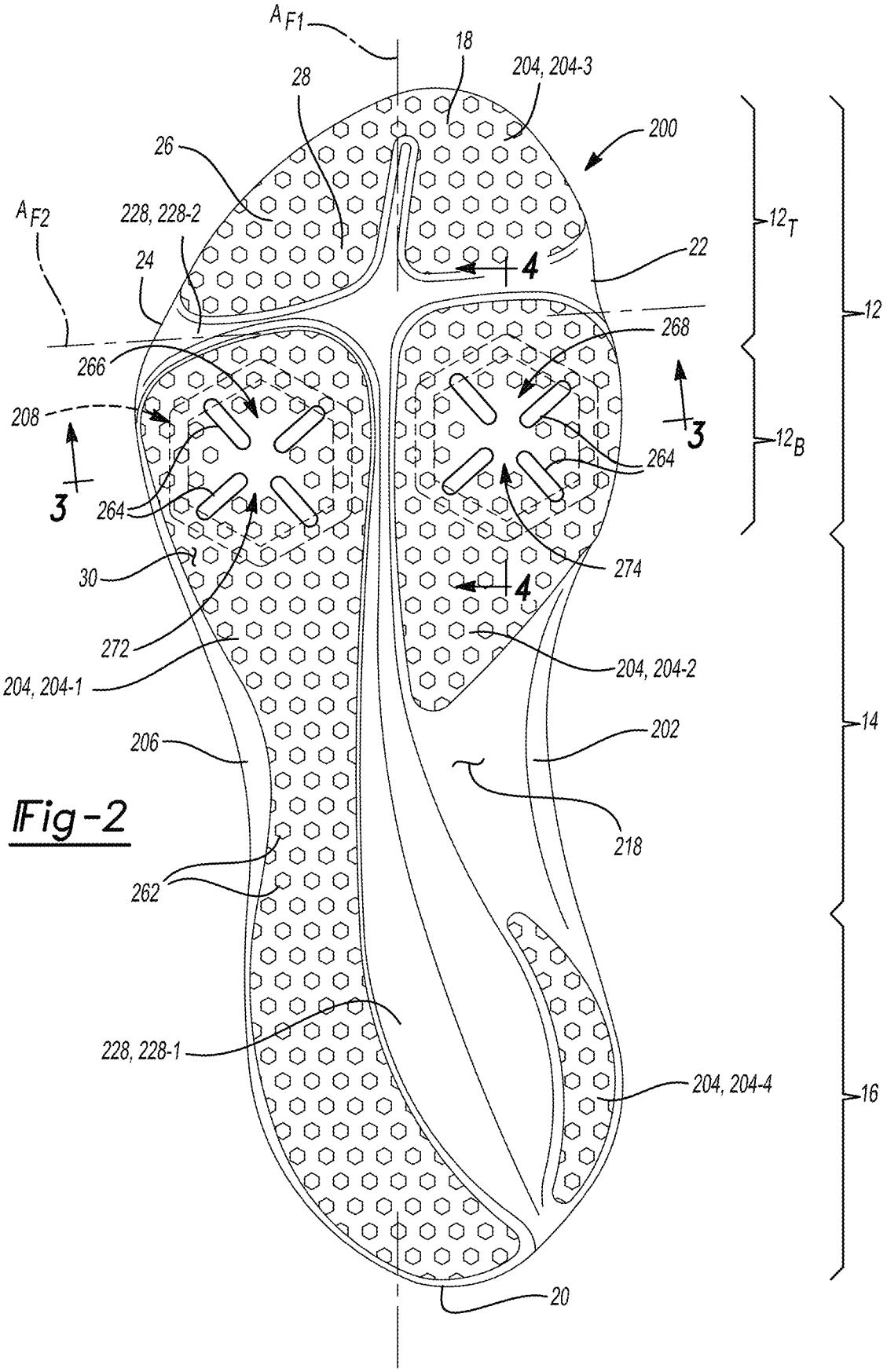
FIG. 2 is bottom plan view of a sole structure of the article of footwear of FIG. 1.
Figure 3:
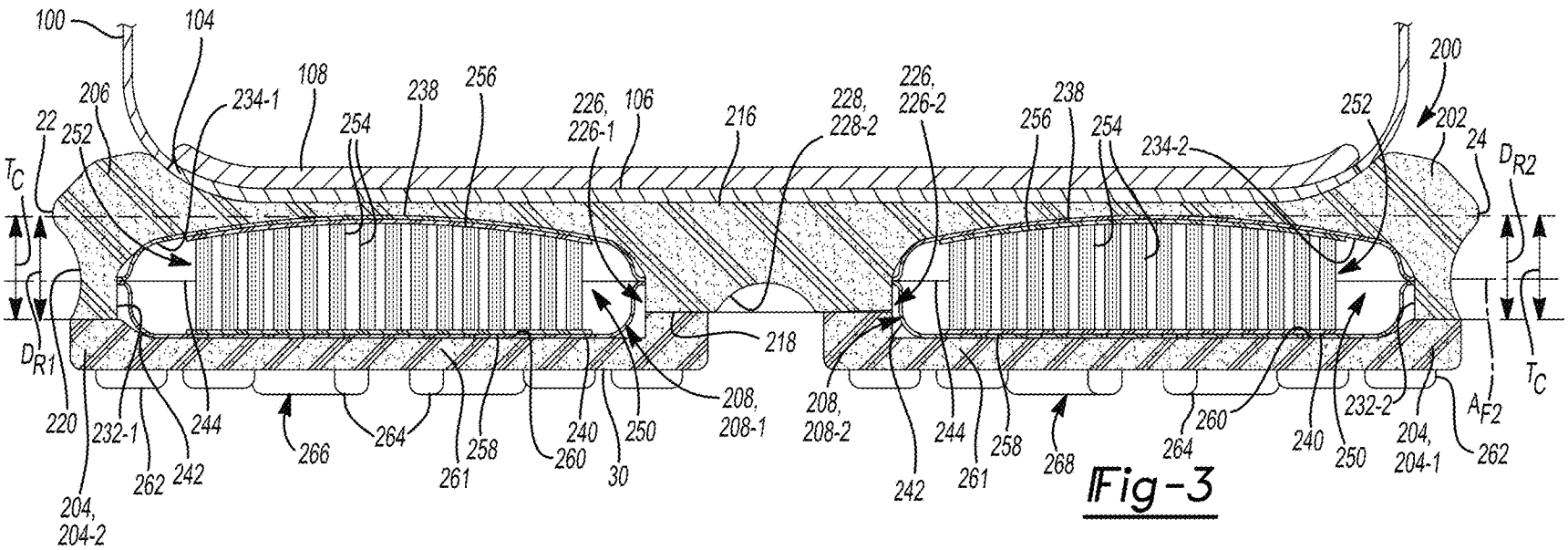
FIG. 3 is a cross-sectional view of the sole structure of FIG. 2, taken along line 3-3 of FIG. 2 corresponding to a lateral axis of the sole structure.

The footwear 10 may further include an anterior end 18 associated with a forward-most point of the forefoot region 12, and a posterior end 20 corresponding to a rearward-most point of the heel region 16. A longitudinal axis $A_{F1}$ of the footwear 10 extends along a length of the footwear 10 from the anterior end 18 to the posterior end 20, parallel to a ground surface. The longitudinal axis $A_{F1}$ may be centrally located along the length of the footwear 10, such that the longitudinal axis $A_{F1}$ generally divides the footwear 10 into a medial side 22 and a lateral side 24. Accordingly, the medial side 22 and the lateral side 24 respectively correspond with opposite sides of the footwear 10 and extend through the regions 12, 14, 16. As illustrated in FIGS. 2 and 3, a lateral axis $A_{F2}$ of the footwear 10 extends along a width of the footwear 10 from the medial side 22 to the lateral side 24, parallel to a ground surface, such that the lateral axis $A_{F2}$ is disposed orthogonal to the longitudinal axis $A_{F1}$. As used herein, a longitudinal direction refers to the direction extending from the anterior end 18 to the posterior end 20, while a lateral direction refers to the direction transverse to the longitudinal direction and extending from the medial side 22 to the lateral side 24.

The article of footwear 10, and more particularly, the sole structure 200, may be further described as including a peripheral region 26 and an interior region 28, as illustrated in FIG. 2. The peripheral region 26 is generally described as being a region between the interior region 28 and an outer perimeter of the sole structure 200. Particularly, the peripheral region 26 extends from the forefoot region 12 to the heel region 16 along each of the medial side 22 and the lateral side 24, and wraps around each of the forefoot region 12 and the heel region 16. The interior region 28 is circumscribed by the peripheral region 26, and extends from the forefoot region 12 to the heel region 16 along a central portion of the sole structure 200. Accordingly, each of the forefoot region 12, the mid-foot region 14, and the heel region 16 may be described as including the peripheral region 26 and the interior region 28.

The upper 100 includes interior surfaces 101 that define an interior void 102 configured to receive and secure a foot for support on the sole structure 200. The upper 100 may be formed from one or more materials that are stitched or adhesively bonded together to form the interior void 102. Suitable materials of the upper 100 may include, but are not limited to, mesh, textiles, foam, leather, and synthetic leather. The materials may be selected and located to impart properties of durability, air-permeability, wear-resistance, flexibility, and comfort.

Figure 4:
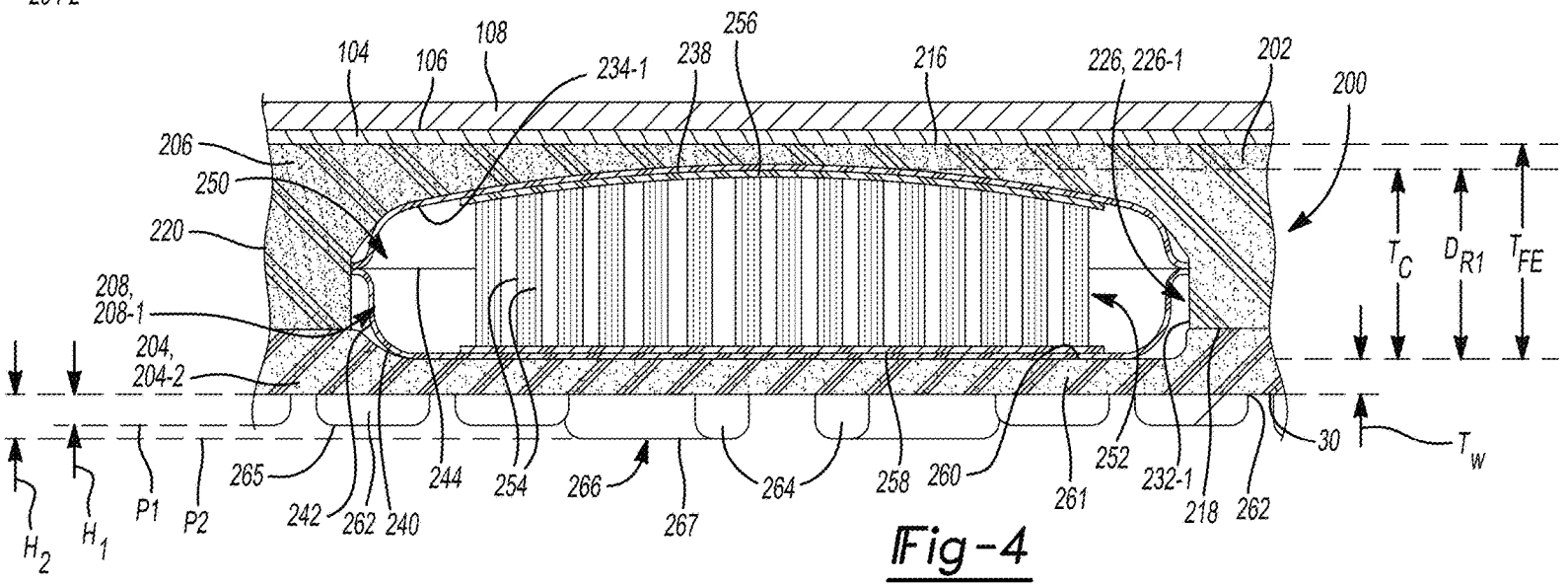
FIG. 4 is a cross-sectional view of the sole structure of FIG. 2, taken along line 4-4 of FIG. 2 and corresponding to a longitudinal axis of the sole structure.

With reference to FIGS. 3 and 4, in some examples, the upper 100 includes a strobel 104 having a bottom surface opposing the sole structure 200 and an opposing top surface defining a footbed 106 of the interior void 102. Stitching or adhesives may secure the strobel to the upper 100. The footbed 106 may be contoured to conform to a profile of the bottom surface (e.g., plantar) of the foot. Optionally, the upper 100 may also incorporate additional layers such as an insole 108 or sockliner that may be disposed upon the strobel 104. The insole or sockliner 108 may reside within the interior void 102 of the upper 100 and be positioned to receive a plantar surface of the foot to enhance the comfort of the article of footwear 10. Referring again to FIG. 1, an ankle opening 114 in the heel region 16 may provide access to the interior void 102. For example, the ankle opening 114 may receive a foot to secure the foot within the void 102 and to facilitate entry and removal of the foot from and to the interior void 102.

In some examples, one or more fasteners 110 extend along the upper 100 to adjust a fit of the interior void 102 around the foot and to accommodate entry and removal of the foot therefrom. The upper 100 may include apertures, such as eyelets and/or other engagement features such as fabric or mesh loops that receive the fasteners 110. The fasteners 110 may include laces, straps, cords, hook-and-loop, or any other suitable type of fastener. The upper 100 may include a tongue portion 116 that extends between the interior void 102 and the fasteners 110.

With reference to FIGS. 1-4, the sole structure 200 includes a midsole 202 configured to provide cushioning characteristics to the sole structure 200, and one or more outsole members 204 configured to provide a ground-engaging surface 30 of the article of footwear 10. As illustrated in FIGS. 3 and 4, the midsole 202 may include a plurality of subcomponents for providing zonal cushioning and performance characteristics. For example, the midsole 202 may include a primary member 206 and one or more secondary members or inserts 208. While the secondary members 208 are generally shown and described herein as being fluid-filled bladders 208, the secondary members 208 may have other configurations (e.g., a foam construct) within the scope of the present disclosure. Similarly, while the midsole 202 is generally shown and described herein as including two bladders 208, the midsole 202 may include more or less than two bladders 208 within the scope of the present disclosure.

As illustrated in FIG. 1, the primary member 206 extends from a first end 212, which may be disposed at the anterior end 18 of the footwear 10, to a second end 214, which may be disposed at the posterior end 20 of the footwear. Accordingly, the primary member 206 may extend along an entire length of the footwear 10. With reference to FIGS. 3 and 4, the primary member 206 may further include a top surface 216 and a bottom surface 218 formed on an opposite side of the primary member 206 than the top surface 216. The top surface 216 of the primary member 206 is configured to oppose the strobel 104 of the upper 100, and may be contoured to define a profile of the footbed 106 corresponding to a shape of the foot. As shown in FIG. 4, a distance between the top surface 216 and the bottom surface 218 defines a thickness $T_{FE}$ of the primary member 206, which may vary along the length or width of the sole structure 200 (e.g., along the axes $A_{F1}$, $A_{F2}$).

The primary member 206 further includes a peripheral side surface 220 extending between the top surface 216 and the bottom surface 218. The peripheral side surface 220 generally defines an outer periphery of the sole structure 200.

As illustrated in FIGS. 2 and 3, the primary member 206 may include one or more recesses 226 and one or more channels 228. For example, the recesses 226 and channels 228 may be formed in the bottom surface 218. The recesses 226 may be sized and shaped to receive each bladder 208. In this regard, as illustrated, in some implementations, a first recess 226, 226-1 is formed in the forefoot region 12 of the sole structure 200 on the medial side 22, and a second recess 226, 226-2 is formed in the forefoot region 12 of the sole structure 200 on the lateral side 24. The first and second recesses 226-1, 226-2 may be aligned along, or in a direction substantially parallel to (+/− five degrees) the lateral axis $A_{F2}$.

The first and second recesses 226-1, 226-2 may be defined by first and second peripheral surfaces 232-1, 232-2 and first and second intermediate surfaces 234-1, 234-2, respectively. The peripheral surfaces 232-1, 232-2 may extend from the bottom surface 218 of the primary member 206 towards the top surface 216. In particular, the peripheral surfaces 232-1, 232-2 may extend partially from the bottom surface 218 toward the top surface 216 and terminate at the intermediate surfaces 234-1, 234-2, respectively, disposed between the bottom surface 218 and the top surface 216. Thus, as illustrated in FIG. 3, a depth $D_{R1}$, $D_{R2}$ of the recesses 226-1, 226-2, measured from the bottom surface 218 to the intermediate surfaces 234-1, 234-2, respectively, extends only partially through the thickness $T_{FE}$ of the primary member 206.

As illustrated in FIG. 2, in some implementations, a first channel 228, 228-1 extends from the forefoot region 12 of the sole structure 200 to the heel region 16 of the sole structure 200, and a second channel 228, 228-2 extends from the medial side 22 of the sole structure 200 to the lateral side of the sole structure 200. For example, the first channel 228-1 may be aligned with, or extend in a direction substantially parallel to (+/− five degrees), the longitudinal axis $A_{F1}$, and the second channel 228-2 may be aligned with, or extend in a direction substantially parallel to (+/− five degrees), the lateral axis $A_{F2}$. In this regard, the longitudinal axis $A_{F1}$ be disposed between the first recess 226-1 and the second recess 228-2, and the second channel 228-2 may be disposed between the anterior end 18 of the footwear 10 and the first and second recesses 226-1, 226-2. As will be explained in more detail below, the configuration of the first and second channels 228-1, 228-2 may provide increased flexibility and responsiveness relative to the longitudinal and lateral axes $A_{F1}$, $A_{F2}$ as the midsole 202 resiliently compresses under an applied load during use.

The bladders 208 may be constructed in a similar manner to each other. For example, each bladder 208 may include a first barrier layer 238 and a second barrier layer 240 opposing the first barrier layer 238, which can be joined to each other at discrete locations to define a chamber 242 and a peripheral seam 244.

In some implementations, the first barrier layer 238 and the second barrier layer 240 cooperate to define a geometry (e.g., thicknesses, width, and lengths) of the chamber 242. The peripheral seam 244 may bound the periphery of the chamber 242 to seal the fluid (e.g., air) within the chamber 242. Thus, the chamber 242 is associated with an area of the bladder 208 where interior surfaces of the first barrier layer 238 and the second barrier layer 240 are not joined together and, thus, are separated from one another. In the illustrated example, an outer peripheral profile of the chamber 242 has a cross-sectional shape corresponding to a hexagon, as best shown in FIG. 2. The outer peripheral profile of the chamber 242 may define various other shapes (e.g., round, oval, rounded square, etc.) within the scope of the present disclosure.

In the illustrated example, the first and second barrier layers 238, 240 are substantially planar. In other implementations, one or both of the first or second barrier layer 238, 240 is cup-shaped (e.g., concave or convex). As shown in FIGS. 3 and 4, the second barrier layer 240 opposes the first barrier layer 238 to define a thickness Tc of the chamber 242 extending between opposed outer surfaces 246, 248 of the first and second barrier layers 238, 240, respectively. The thickness Tc may extend in a direction orthogonal to the outer surfaces 246, 248. In some implementations, the thickness Tc is equal to the depths $D_{R1}$, $D_{R2}$ of the respective recesses 226-1, 226-2. In other implementations, the thickness Tc may be less or greater than the depths $D_{R1}$, $D_{R2}$ of the respective recesses 226-1, 226-2.

As shown in the figures, a space formed between opposing interior surfaces of the first barrier layer 238 and the second barrier layer 240 defines an interior void 250 of the chamber 242. The interior void 250 of the chamber 242 may receive a tensile element 252 therein. Each tensile element 252 may include a series of tensile strands 254 extending between a first tensile sheet 256 and a second tensile sheet 258. The first tensile sheet 256 may be attached to the first barrier layer 238 while the second tensile sheet 258 may be attached to the second barrier layer 240. In this manner, when the chamber 242 receives the pressurized fluid, the tensile strands 254 of the tensile element 252 are placed in tension. Because the first tensile sheet 256 is attached to the first barrier layer 238 and the second tensile sheet 258 is attached to the second barrier layer 240, the tensile strands 254 retain a desired shape of the bladder 208 when the pressurized fluid is injected into the interior void 250. For example, in the illustrated implementations (FIG. 5), the tensile element 252 maintains substantially planar first and second barrier layers 238, 240. Furthermore, by maintaining substantially planar first and second barrier layers 238, 240, the outer surfaces 246, 248 of the bladder 208, which are collectively defined by the barrier layers 238, 240, are also substantially planar.

Referring to FIG. 2, in the illustrated example, the bladders 208 are arranged to provide cushioning in the forefoot region 12 of the sole structure 200. For example, as illustrated in FIGS. 3 and 4, the bladders 208 may be disposed within the first and second recesses 226-1, 226-2. In particular, a first bladder 208, 208-1 may be coupled to one or both of the first peripheral surface 232-1 or the first intermediate surface 20, and a second bladder 208, 208-2 may be coupled to one or both of the second peripheral surface 232-2 or the second intermediate surface 234-2, using various methods of bonding, including adhesively bonding or melding, for example.

Figure 5:
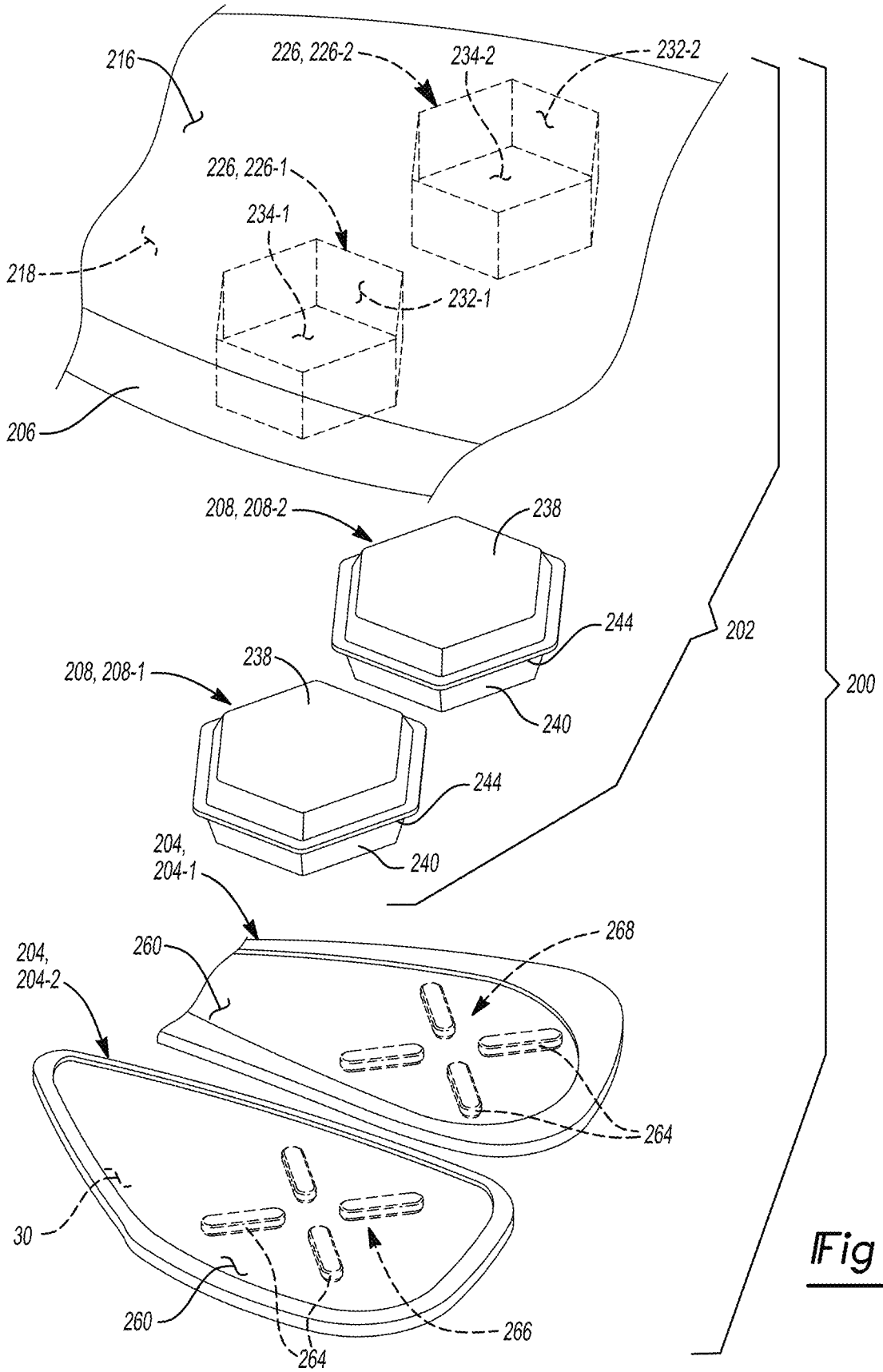
FIG. 5 is an exploded top perspective view of a portion of the sole structure of FIG. 2.

With reference to FIGS. 3-5, in some implementations, the one or more outsole members 204 include first, second, third, and fourth outsole members 204-1, 204-2, 204-3, 204-4. In other implementations, however, the sole structure 200 may include more or less than four outsole members 204. Each outsole member 204 may include an upper surface 260 opposite the ground-engaging surface 30. The upper surface 260 and the ground-engaging surface 30 may define a web 261 having a thickness $T_W$ extending therebetween and having a plurality of first traction elements 262 (e.g., first protrusions) and one or more second traction elements 264 (e.g., second protrusions). In some examples, the thickness $T_W$ of the web 261 may be constant. In some implementations, the thickness $T_W$ may not be constant. For example, as illustrated in FIGS. 3 and 4, the thickness $T_W$ may be smaller in a central region (e.g., the portion that is aligned with the bladders 208) and larger in a peripheral region (e.g., the portion that engages the midsole 202).

The first traction elements 262 and the second traction elements 264 may each define various shapes and heights protruding from the ground-engaging surface 30. For example, as illustrated in FIG. 4, the first traction elements 262 may define a square or hexagonal shape and may protrude from the ground-engaging surface 30 by a first height H1, while the second traction elements 264 may define an oblong (e.g., stadium or ellipse) shape and may protrude from the ground-engaging surface 30 by a second height H2. In some examples, one or more of the first traction elements 262 includes a distal end 265 offset from the ground-engaging surface 30 and defining the first height H1, and one or more of the second traction elements 264 includes a distal end 267 offset from the ground-engaging surface 30 and defining the second height H2.

In some implementations, the second height H2 is greater than the first height H1 and is greater than the thickness $T_W$ of the web 261. For example, the second height H2 may be 5%-25% greater than the first height H1 and 25%-200% greater than the thickness $T_W$ of the web 261. In some implementations, the second height H2 may be approximately 0.5 millimeters greater than the first height H1 and approximately 2.25 millimeters greater than the thickness $T_W$ of the web 261. Accordingly, during use, the second traction elements 264 may engage a surface of the ground prior to the first traction elements 262, such that the surface of the ground applies a force on the second traction elements 264 prior to applying a force on the first traction elements 262. The ratio of the second height H2 to the thickness $T_W$ of the web 261 can allow the web 261 to flex upon application of the force on the second traction elements 264 by the surface of the ground. In some examples, the distal ends 265 of the first traction elements 262 are disposed in a first plane P1, and the distal ends 267 of the second traction elements 264 are disposed in a second plane P2. The first plane P1 may be disposed between the second plane P2 and the ground-engaging surface 30. In some implementations, the first plane P1 is substantially parallel (+/−5 degrees) to the second plane P1 and/or the ground-engaging surface 30.

As illustrated in FIGS. 2 and 5, in some implementations, the ground-engaging surface 30 includes eight (8) second traction elements 264. In particular, the ground-engaging surface 30 of the first outsole member 204-1 may include four (4) second traction elements 264 arranged in a first pattern 266, and the second outsole member 204-2 may include four (4) second traction elements 264 arranged in a second pattern 268. As illustrated, in some implementations, the first and second patterns 266, 268 each define an X-shape. As will be described in more detail below, in the assembled configuration, at least one of the second traction elements 264 may be aligned with the recess(es) 226. For example, the first pattern 266 may be aligned with the first recess 226-1, and the second pattern 268 may be aligned with the second recess 226-2.

The outsole 204 and the subcomponents 206, 208 of the midsole 202 may be assembled and secured to each other using various methods of bonding, including adhesively bonding and melding, for example. As described in greater detail below, the outsole 204 may be overmolded onto the subcomponents 206, 208 of the midsole 202, such that the midsole 202 defines a profile of the ground-engaging surface 30 of the footwear 10. Alternatively, the outsole 204 may be bonded to the midsole 202 using an adhesive or other suitable attachment method.

As illustrated in FIG. 4, in some implementations, during use, the relationship of the second height H2 of the second traction elements 264 to the first height H1 of the first traction elements 262 can allow the second traction elements 264 to engage a surface of the ground before the first traction elements 262 engage the ground, such that the surface of the ground applies a force on the second traction elements 264 prior to applying a force on the first traction elements 262. In this regard, the force applied by the ground on the second traction elements 264 may be greater than the force applied by the ground on the first traction elements 262. The relationship between the second height H2 to the thickness $T_W$ of the web 261 can allow the web 261 to efficiently flex upon application of the force on the second traction elements 264 by the ground, such that the force is efficiently transmitted through the second traction elements 264 onto the bladder 208.

In so doing, the bladder 208 is essentially subjected to a form of a point load by the second traction elements 264, thereby reducing the force required to load and deform the bladder 208. The load required to load and deform the bladder 208 is reduced in comparison to a load that is evenly applied across an entire surface of the bladder 208. As such, higher-pressure bladders 208 may be incorporated into sole structures intended for use with lighter-weight individuals such as children.

Figure 6:
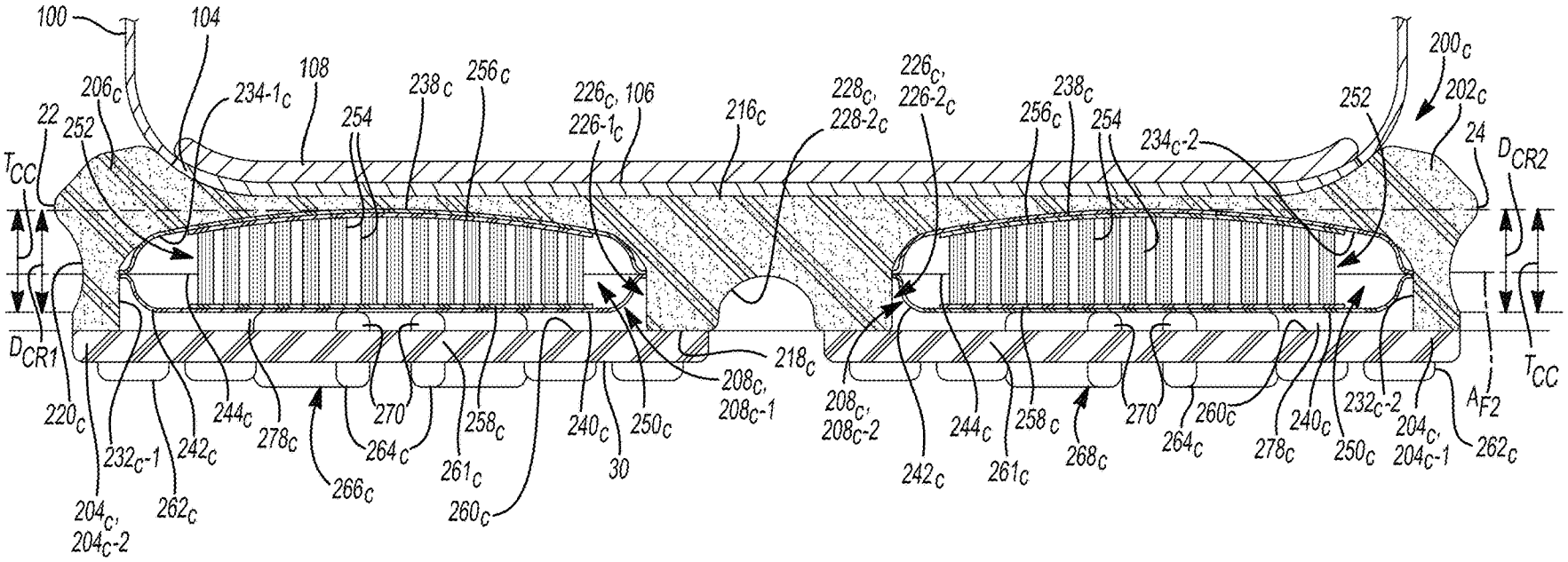
FIG. 6 is a cross-sectional view of another sole structure for an article of footwear in accordance with principles of the present disclosure, the cross section taken along a line corresponding to a lateral axis of the sole structure.
Figure 7:
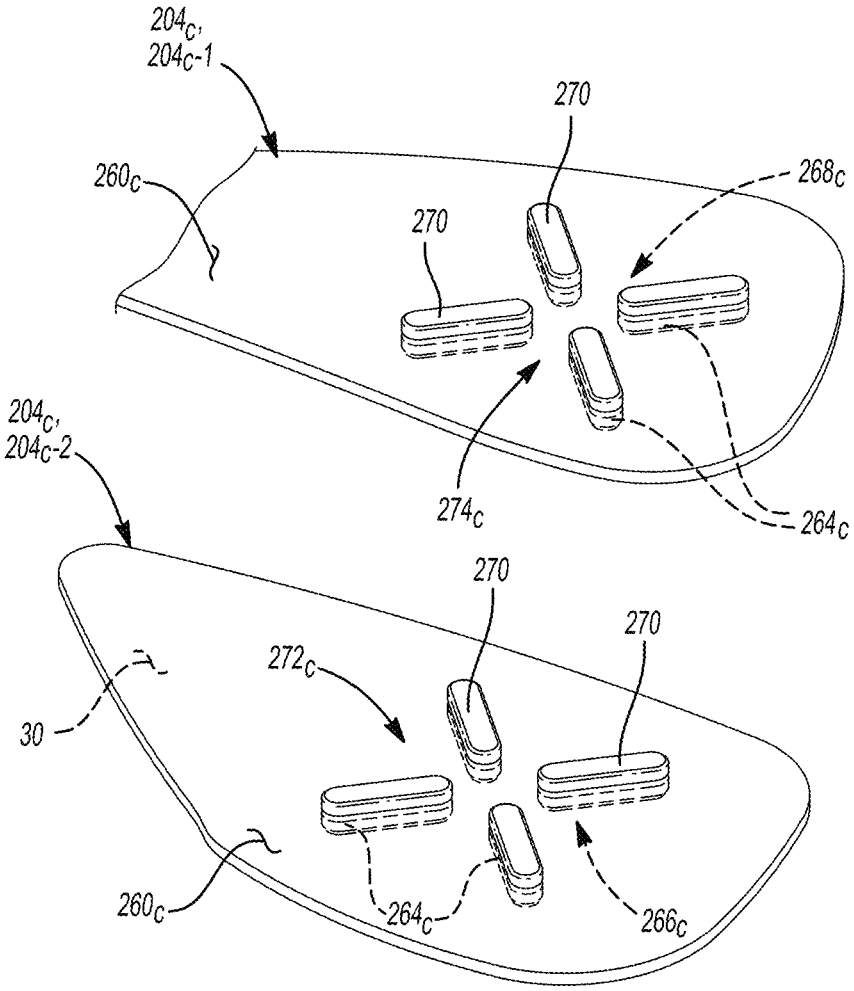
FIG. 7 is a top perspective view of a portion of an outsole of the sole structure of FIG. 6.

Referring now to FIGS. 6 and 7, a sole structure 200*c* for use with an article of footwear (e.g., article of footwear 10) is provided. For example, the sole structure 200*c* may be used with, and attached to, the upper 100 of the article of footwear 10 in place of the sole structure 200. In view of the substantial similarity in structure and function of the components associated with the sole structure 200*c* with respect to the sole structure 200, like reference numerals are used hereinafter and in the drawings to identify like components while like reference numerals containing letter extensions (e.g., "c") are used to identify those components that have been modified.

With reference to FIG. 6, in some implementations, the sole structure 202*c* includes one or more outsole members 204*c*-1, 204*c*-2 . . . 204*c*-*n* coupled to a midsole 202*c*. For example, the outsole 204*c* and the midsole 202*c* may be assembled and secured to each other using various methods of bonding, including adhesively bonding and melding, for example. In particular, the outsole 204*c* may be overmolded onto the subcomponents 206*c*, 208*c* of the midsole 202*c*, such that the midsole 202*c* defines a profile of the ground-engaging surface 30 of the footwear 10. Alternatively, the outsole 204*c* may be bonded to the midsole 202*c* using an adhesive or other suitable attachment method.

The upper surface 260*c* of the first outsole member 204*c*-1 may include a plurality of protrusions 270. The protrusions 270 may each define various shapes and heights protruding from the upper surface 260*c*. For example, the protrusions 270 may define an oblong (e.g., stadium or ellipse) shape. As illustrated in FIG. 7, in some implementations, the upper surface 260*c* includes eight protrusions 270. In particular, the upper surface 260*c* of the first outsole member 204*c*-1 may include four elongate protrusions 270 arranged in a first pattern 272*c*, and the upper surface 260*c* of the second outsole member 204*c*-2 may include four elongate protrusions 270 arranged in a second pattern 274*c*. As illustrated, in some implementations, the first and second patterns 272*c*, 274*c* each define an X-shape. In this regard, the first and second patterns 272*c*, 274*c* of the protrusions 270 may be the same as the first and second patterns 266*c*, 268*c* of the second traction elements 268*c*. In particular, the size, shape, and arrangement of the protrusions 270 may be the same as the size, shape, and arrangement of the second traction elements 268*c*, such that each protrusion 270 is aligned with one of the second traction elements 268*c*. Accordingly, as will be described in more detail below, in the assembled configuration, at least one of the protrusions 270 may be aligned with the recess(es) 226*c* and, thus, the bladder 208 disposed therein. For example, the first pattern 272*c* may be aligned with the first recess 226*c*-1, and the second pattern 274*c* may be aligned with the second recess 226*c*-2.

Referring to FIG. 6, when the sole structure 200*c* is assembled, the first patterns 266*c*, 272*c* may be aligned with the first recess 226*c*-1, and the second patterns 268*c*, 274*c* may be aligned with the second recess 226*c*-2, as previously described, to provide localized cushioning characteristics to the sole structure 200*c*. In some implementations, one or more of the protrusions 270 may engage the bladder(s) 208*c* (e.g., the second barrier layer 240*c*), such that the upper surface 260*c* is spaced apart from the bladder(s) 208*c*. In particular, the upper surface 260*c* and the second barrier layer 240*c* may define a void 278*c* surrounding the protrusions 270*c*. In some implementations, at least a portion of one or more of the protrusions 270 may be disposed within the first recess 226*c*-1 or the second recess 226*c*-2. For example, relative to the thickness $Tc_{FE}$ of the primary member 206*c*, at least a portion of each protrusion 270 may be disposed between the bottom surface 218*c* of the midsole 202*c* and the intermediate surface 234*c*-1, 234*c*-2 of one of the first or second recesses 226*c*-1, 226*c*-2, respectively.

With this arrangement, the cushioning and performance properties of the bladder 208*c* are effectively and efficiently imparted to the ground-engaging surface 30. Particularly, forces associated with pushing off of the forefoot during running or jumping motions may be more efficiently absorbed by the bladder 208*c*, as such forces will first be imparted onto the bladder 208*c* by the protrusions 270, effectively reducing the amount of force required to deflect the second barrier layer 240*c* of the bladder 208*c*. For example, as previously described, during use, the height of the second traction elements 264*c* and the height of the first traction elements 262*c* are substantially similar, such that the surface of the ground simultaneously applies a force on the second traction elements 264*c* and the first traction elements 262*c*. In this regard, the force applied by the ground on the second traction elements 264*c* may be substantially similar as the force applied by the ground on the first traction elements 262*c*. In some implementations, upon application of the force on the second traction elements 264*c* by the ground, the force is efficiently transmitted through the second traction elements 264*c* to the protrusions 270 and imparted onto the bladder 208*c* by the protrusions 270.

Figure 8:
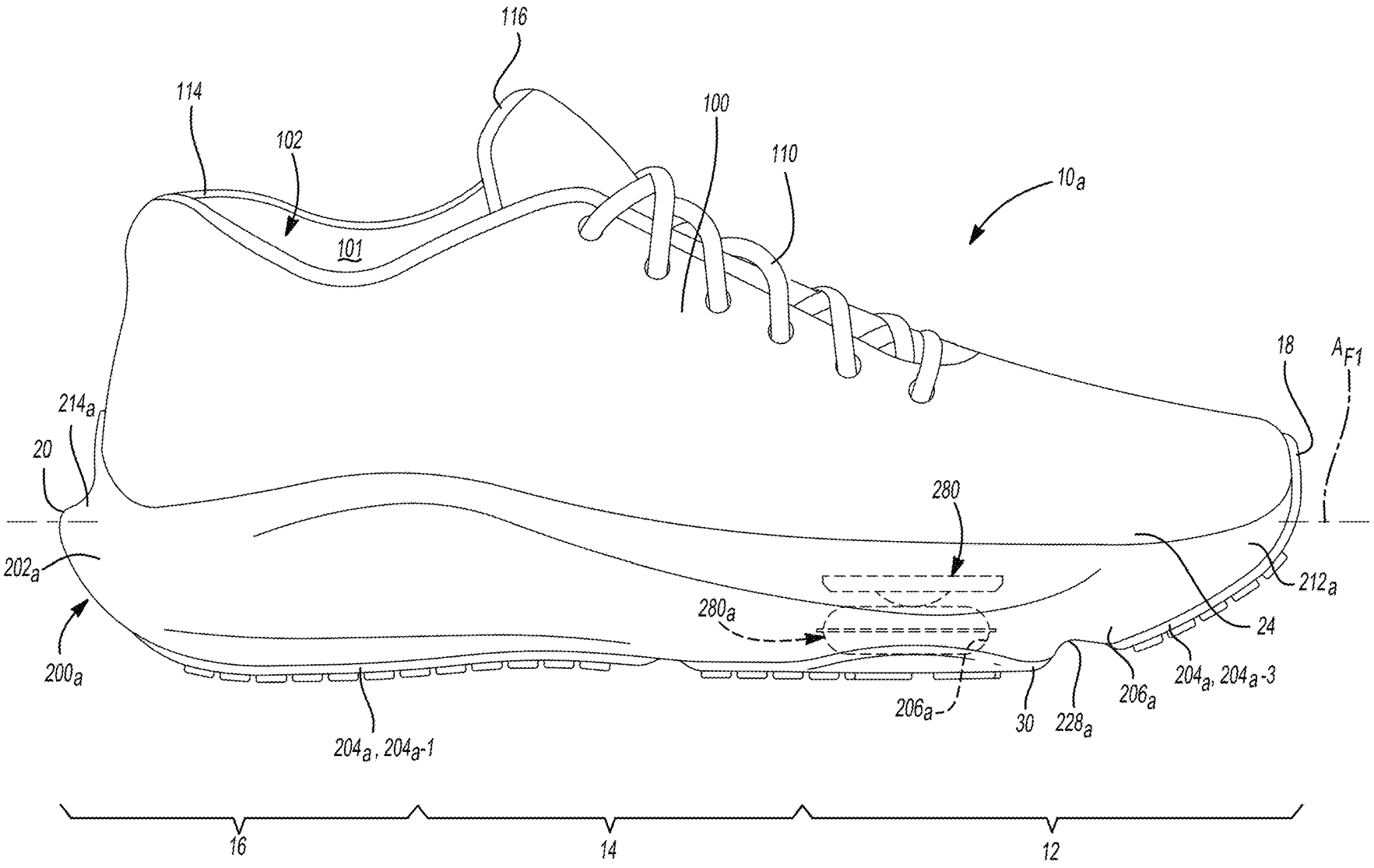
FIG. 8 is a side elevation view of another article of footwear in accordance with principles of the present disclosure.

Referring now to FIG. 8, an article of footwear 10*a* is provided and includes the upper 100 and a sole structure 200*a* attached to the upper 100. In view of the substantial similarity in structure and function of the components associated with the article of footwear 10*a* with respect to the article of footwear 10, like reference numerals are used hereinafter and in the drawings to identify like components while like reference numerals containing letter extensions are used to identify those components that have been modified.

As illustrated in FIGS. 8-11, the sole structure 200*a* includes a midsole 202*a* configured to provide cushioning characteristics to the sole structure 200*a*, and one or more of the outsole members 204*a* configured to provide a ground-engaging surface 30 of the article of footwear 10*a*. As illustrated, the midsole 202*a* may include a plurality of subcomponents for providing zonal cushioning and performance characteristics. For example, the midsole 202*a* may include a primary member 206*a*, one or more secondary members or inserts 208*a*, and one or more actuation members 280. While the secondary members 208*a* are generally shown and described herein as being fluid-filled bladders 208*a*, the secondary members 208*a* may have other configurations (e.g., a foam construct) within the scope of the present disclosure. Similarly, while the midsole 202*a* is generally shown and described herein as including two bladders 208*a*, the midsole 202*a* may include more or less than two bladders 208*a* within the scope of the present disclosure.

Figure 10:
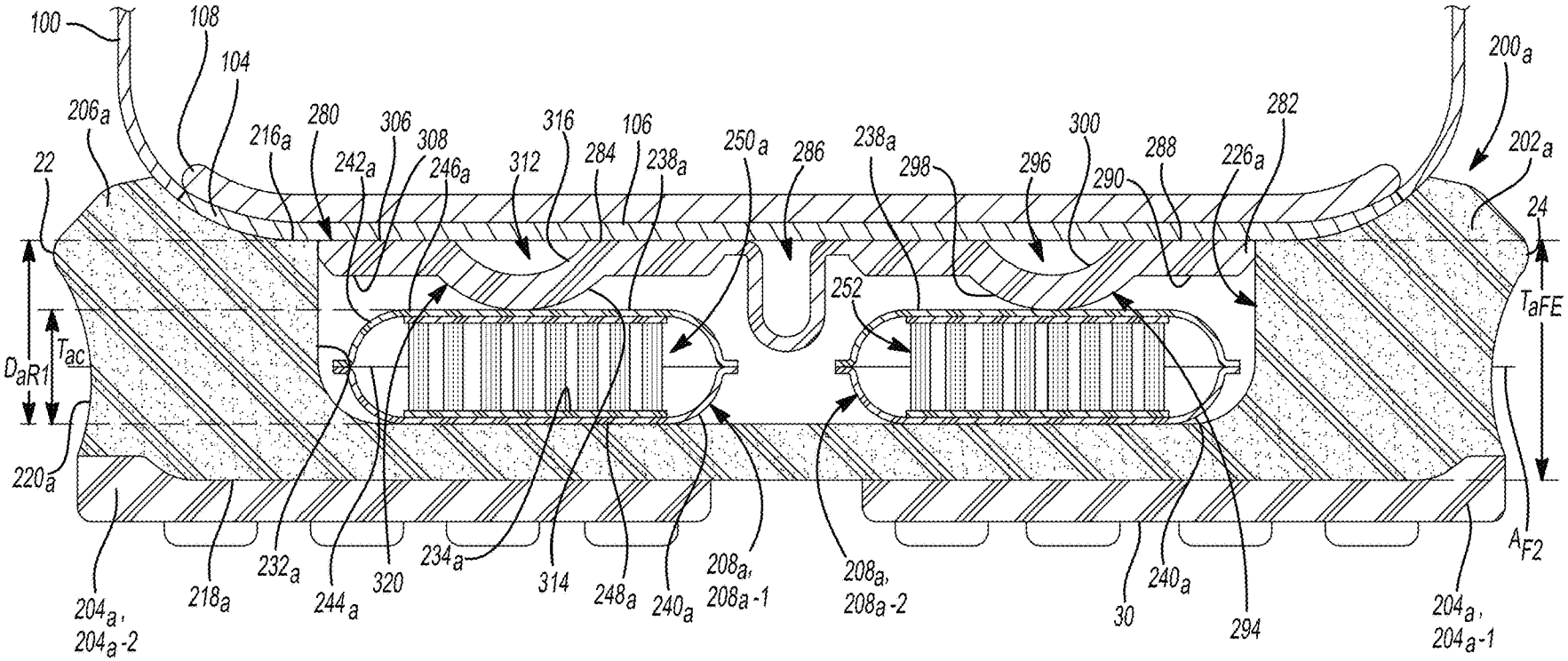
FIG. 10 is a cross-sectional view of the sole structure of FIG. 9, taken along line 10-10 of FIG. 9 corresponding to a lateral axis of the sole structure.

As illustrated in FIG. 8, the primary member 206*a* extends from a first end 212*a*, which may be disposed at the anterior end 18 of the footwear 10*a*, to a second end 214*a*, which may be disposed at the posterior end 20 of the footwear 10*a*. Accordingly, the primary member 206*a* may extend along an entire length of the footwear 10*a*. With reference to FIG. 10, the primary member 206*a* may further include a top surface 216*a* and a bottom surface 218*a* formed on an opposite side of the primary member 206*a* than the top surface 216*a*. The top surface 216*a* of the primary member 206*a* is configured to oppose the strobel 104 of the upper 100, and may be contoured to define a profile of the footbed 106 corresponding to a shape of the foot. As shown in FIG. 10, a distance between the top surface 216*a* and the bottom surface 218*a* defines a thickness $Ta_{FE}$ of the primary member 206*a*, which may vary along the length or width of the sole structure 200*a* (e.g., along the axes $A_{F1}$, $A_{F2}$).

The primary member 206*a* further includes a peripheral side surface 220*a* extending between the top surface 216*a* and the bottom surface 218*a*. The peripheral side surface 220*a* generally defines an outer periphery of the sole structure 200*a*.

Figure 9:
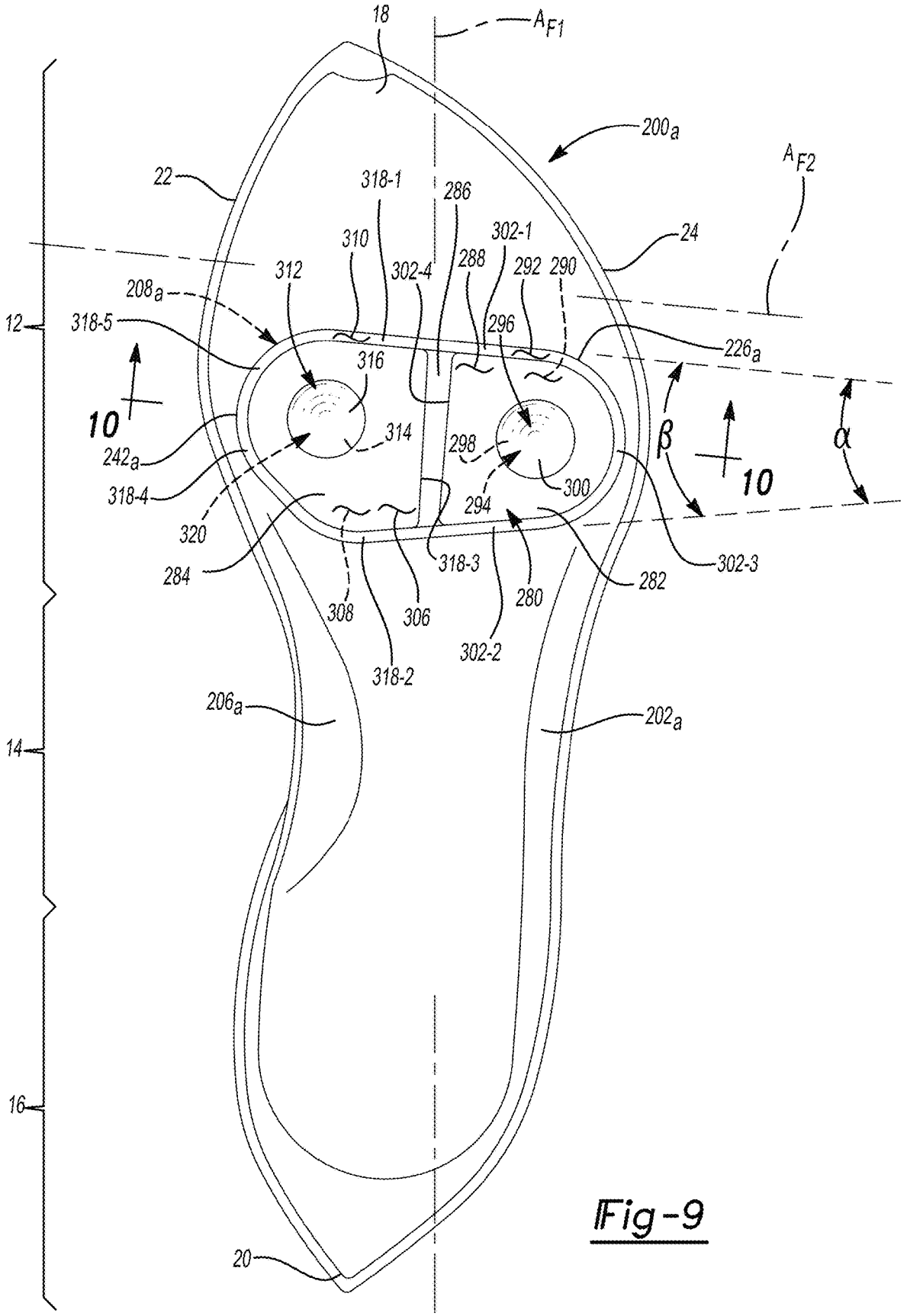
FIG. 9 is a top plan view of a sole structure of the article of footwear of FIG. 8.

As illustrated in FIG. 9, the primary member 206*a* may include one or more recesses 226*a* formed in the top surface 216*a*. The recesses 226*a* may be sized and shaped to receive each bladder 208*a*. In this regard, as illustrated, in some implementations, the primary member 206*a* includes a single recess 226*a* formed in the forefoot region 12 of the sole structure 200*a* between the medial side 22 and the lateral side 24. The recess 226*a* may be aligned along, or in a direction substantially parallel to (+/− five degrees) the lateral axis $A_{F2}$.

Figure 11:
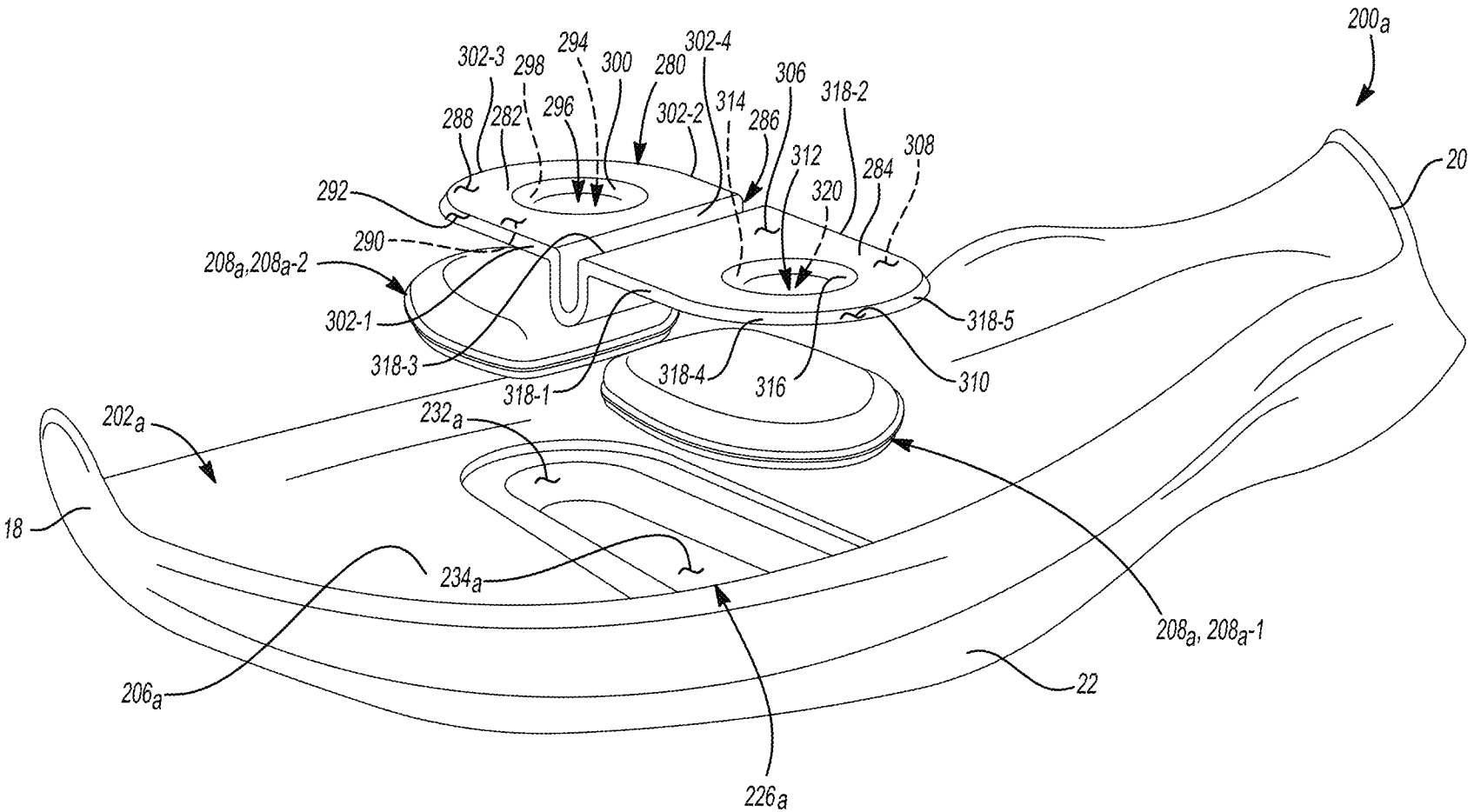
FIG. 11 is an exploded top perspective view of the sole structure of FIG. 9.

With reference to FIGS. 10 and 11, the recess 226*a* may be defined by a peripheral surface 232*a* and an intermediate surface 234*a*. The peripheral surface 232*a* may extend from the top surface 216*a* of the primary member 206*a* towards the bottom surface 218*a*. In particular, the peripheral surface 232*a* may extend partially from the top surface 216*a* towards the bottom surface 218*a* and terminate at the intermediate surface 234*a*, disposed between the bottom surface 218*a* and the top surface 216*a*. Thus, as illustrated in FIG. 10, a depth Dam of the recess 226*a*, measured from the top surface 216*a* to the intermediate surface 234*a*, extends only partially through the thickness $Ta_{FE}$ of the primary member 206*a*.

Each bladder 208*a* may include a first barrier layer 238*a* and a second barrier layer 240*a* opposing the first barrier layer 238*a*. The first barrier layer 238*a* and the second barrier layer 240*a* can be joined to each other at discrete locations to define a chamber 242*a* and a peripheral seam 244*a*.

In some implementations, the first barrier layer 238*a* and the second barrier layer 240*a* cooperate to define a geometry (e.g., thicknesses, width, and lengths) of the chamber 242*a*. The peripheral seam 244*a* may bound the periphery of the chamber 242*a* to seal the fluid (e.g., air) within the chamber 242*a*. Thus, the chamber 242*a* is associated with an area of the bladder 208*a* where interior surfaces of the first barrier layer 238*a* and the second barrier layer 240*a* are not joined together and, thus, are separated from one another. In the illustrated example, an outer peripheral profile of the chamber 242*a* has a rounded cross-sectional shape, as best shown in FIG. 11. The outer peripheral profile of the chamber 242*a* may define various other shapes (e.g., circular, oval, rounded square, etc.) within the scope of the present disclosure.

As shown in FIG. 10, the second barrier layer 240*a* opposes the first barrier layer 238*a* to define a thickness Tac of the chamber 242*a* extending between opposed outer surfaces 246*a*, 248*a* of the first and second barrier layers 238*a*, 240*a*, respectively. The thickness Tac may extend in a direction orthogonal to the outer surfaces 246*a*, 248*a*. In some implementations, the thickness Tac is equal to the depth Dam of the recess 226*a*. In other implementations, the thickness Tac may be less than the depth Dam the recess 226*a*. In the illustrated example, the first barrier layer 238*a* (e.g., the outer surface 246*a*) and the second barrier layer 240*a* (e.g., the outer surface 248*a*) are substantially planar. In other implementations, one or both of the first or second barrier layer 238*a*, 240*a* (e.g., the outer surfaces 246*a*, 248*a*) is cup-shaped (e.g., concave or convex).

As shown in the figures, a space formed between opposing interior surfaces of the first barrier layer 238*a* and the second barrier layer 240*a* defines an interior void 250*a* of the chamber 242*a*. The interior void 250*a* of the chamber 242*a* may receive the tensile element 252 therein in the manner previously described.

Referring to FIG. 11, in the illustrated example, the bladders 208*a* are arranged to provide cushioning in the forefoot region 12 of the sole structure 200*a*. For example, as illustrated, the bladders 208*a* may be disposed within the recess 226*a*. In particular, a first bladder 208*a*, 208*a*-1 may be coupled to one or both of the peripheral surface 232*a* or the intermediate surface 234*a*, and a second bladder 208*a*, 208*a*-2 may be coupled to one or both of the peripheral surface 232*a* or the intermediate surface 234*a*, using various methods of bonding, including adhesively bonding or melding, for example.

With reference to FIGS. 8 and 10, in some implementations, one or more outsole members 204*a*-1, 204*a*-2 . . . 204*a*-*n* may be coupled to the midsole 202*a*. For example, the outsole 204*a* and the midsole 202*a* may be assembled and secured to each other using various methods of bonding, including adhesively bonding and melding, for example. In particular, the outsole 204*a* may be overmolded onto the subcomponents 206*a*, 208*a* of the midsole 202*a*, such that the midsole 202*a* defines a profile of the ground-engaging surface 30 of the footwear 10*a*. Alternatively, the outsole 204*a* may be bonded to the midsole 202*a* using an adhesive or other suitable attachment method.

As illustrated in FIGS. 9-11, the actuation member 280 may include a lateral portion 282, a medial portion 284, and a central portion 286 extending between the lateral portion 282 and the medial portion 284. The lateral portion 282 may include a lateral upper surface 288, a lateral lower surface 290 opposite the lateral upper surface 288, and a lateral peripheral surface 292 extending from the lateral upper surface 288 to the lateral lower surface 290. The lateral portion 282 may further include a lateral protrusion 294 extending from the lateral lower surface 290, and a corresponding lateral recess 296 disposed within the lateral upper surface 288 and aligned with the lateral protrusion 294. For example, the lateral lower surface 290 may include a convex portion 298 corresponding to the lateral protrusion 294, and the lateral upper surface 288 may include a concave portion 300 aligned with the convex portion 298. As illustrated, in some implementations, the convex portion 298 and/or the concave portion 300 define a portion of a sphere (e.g., a semi-spherical shape).

The lateral peripheral surface 292 may include a front segment 302-1, a rear segment 302-2, a lateral segment 302-3, and a medial segment 302-4. As illustrated in FIG. 9, the front and rear segments 302-1, 302-2 may extend linearly and define an angle $\alpha$ therebetween. In some implementations, the angle $\alpha$ is equal to zero degrees, such that the front segment 302-1 is parallel to the rear segment 302-2. In other implementations, the angle $\alpha$ is greater than zero degrees (e.g., between one degree and ten degrees), such that the distance between the front and rear segments 302-1, 302-2 is less proximate the lateral segment 302-3 than it is proximate the medial segment 302-4. The lateral segment 302-3 may extend arcuately from the front segment 302-1 to the rear segment 302-2, while the medial segment 302-4 may extend linearly from the front segment 302-1 to the rear segment 302-2.

The medial portion 284 may include a medial upper surface 306, a medial lower surface 308 opposite the medial upper surface 306, and a medial peripheral surface 310 extending from the medial upper surface 306 to the medial lower surface 308. The medial portion 284 may further include a medial protrusion 320 extending from the medial lower surface 308, and a corresponding medial recess 312 disposed within the medial upper surface 306 and aligned with the medial protrusion 310. For example, the medial lower surface 308 may include a convex portion 314 corresponding to the medial protrusion 320, and the medial upper surface 306 may include a concave portion 316 aligned with the convex portion 314. As illustrated, in some implementations, the convex portion 314 and/or the concave portion 316 define a portion of a sphere (e.g., a semi-spherical shape).

The medial peripheral surface 310 may include a front segment 318-1, a rear segment 318-2, a lateral segment 318-3, a first medial segment 318-4, and a second medial segment 318-5. The front and rear segments medial segment 318-1, 318-2 may extend linearly and define an angle $\beta$ therebetween. In some implementations, the angle $\beta$ is equal to zero degrees, such that the front segment 318-1 is parallel to the rear segment 318-2. In other implementations, the angle $\beta$ is greater than zero degrees (e.g., between one degree and ten degrees), such that the distance between the front and rear segments 318-1, 318-2 is less proximate the lateral segment 318-3 than it is proximate the medial segments 318-4, 318-5. In some implementations, the angle $\beta$ is substantially equal to the angle $\alpha$ such that the front segment 302-1 is collinear with the front segment 318-1, and the rear segment 302-2 is collinear with the rear segment 318-2. The lateral segment 318-3 and the first medial segment 318-4 may extend linearly from the front segment 318-1 to the rear segment 318-2, while the second medial segment 318-5 may extend arcuately from the front segment 318-1 to the rear segment 318-2.

The central portion 286 of the actuation member 280 may connect the lateral portion 282 to the medial portion 284. As illustrated in FIG. 10, in some implementations, the central portion 286 defines a U-shaped cross section in a plane extending perpendicular to the longitudinal and lateral axes $A_{F1}$, $A_{F2}$ of the footwear 10*a*. In some implementations, the central portion 286 extends below the lateral and medial lower surfaces 290, 308 of the lateral and medial portions 282, 284, respectively, such that the lower surfaces 290, 308 are disposed between the upper surfaces 288, 306 and the central portion 286 in a direction transverse to the axes $A_{F1}$, $A_{F2}$ of the footwear 10*a*.

In the assembled configuration, the central portion 286 may be disposed between the medial and lateral sides 22, 24 of the footwear 10*a*. In particular, the central portion 286 may be disposed between the bladders 208*a* and aligned with the longitudinal axis $A_{F1}$ of the footwear 10*a* in the assembled configuration. The actuation member 280 may be constructed at least in part from a flexible and/or resilient material that allows the medial portion 284 to flex and move relative to the lateral portion 282 during use of the footwear 10*a*. In this regard, during use of the footwear 10*a*, the cushioning and performance properties of the bladders 208*a* are effectively and efficiently imparted to the ground-engaging surface 30. Particularly, forces associated with pushing off of the forefoot during running or jumping motions may be more efficiently absorbed by the bladders 208*a*, as such forces will first be imparted onto the bladders 208*a* by the protrusions 294, 310, effectively reducing the amount of force required to deflect the first barrier layers 238*a* of the bladders 208*a*.

Figure 12:
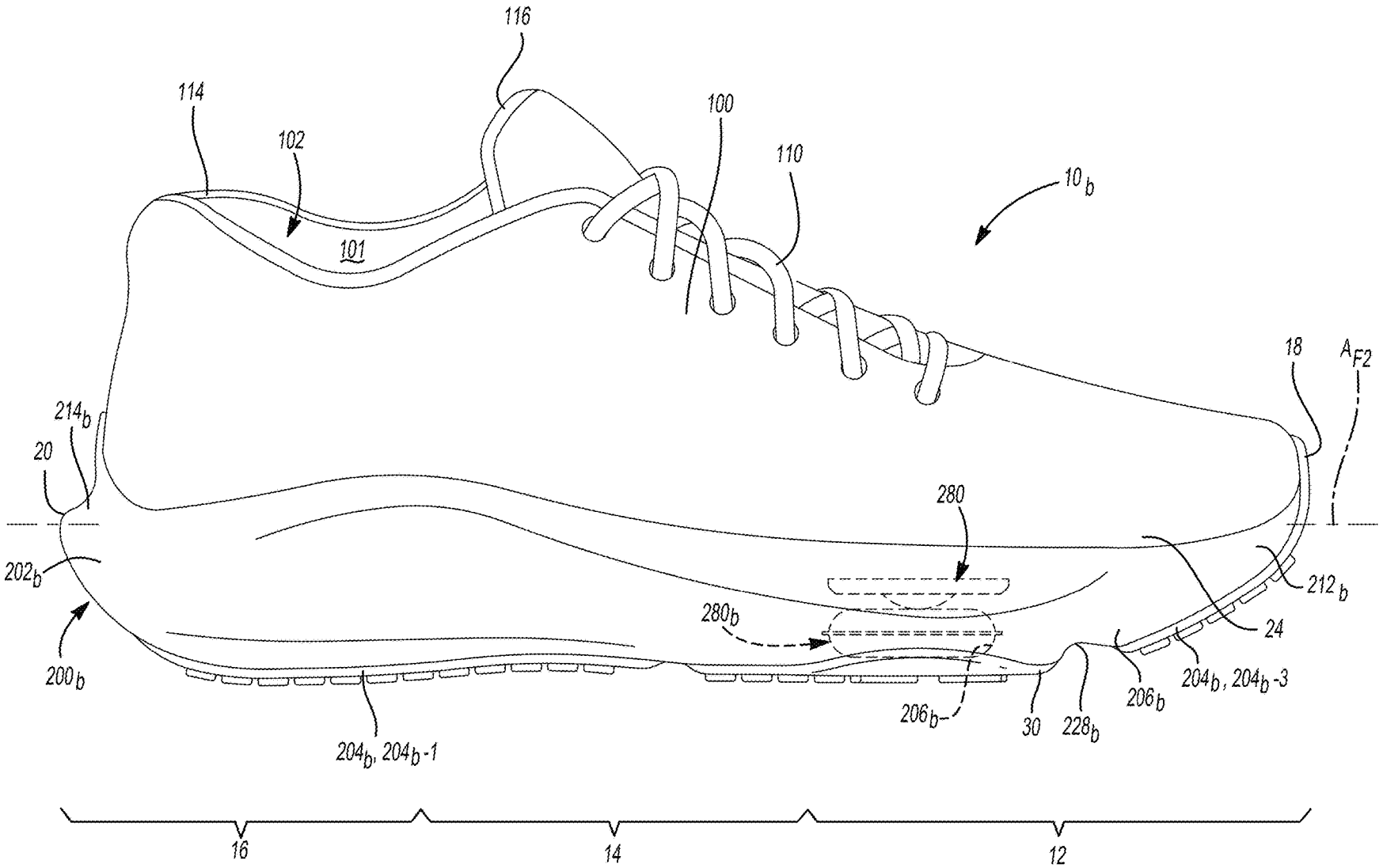
FIG. 12 is a side elevation view of another article of footwear in accordance with principles of the present disclosure.

Referring now to FIG. 12, an article of footwear 10*b* is provided and includes the upper 100 and a sole structure 200*b* attached to the upper 100. In view of the substantial similarity in structure and function of the components associated with the article of footwear 10*b* with respect to the articles of footwear 10, 10*a*, like reference numerals are used hereinafter and in the drawings to identify like components while like reference numerals containing letter extensions are used to identify those components that have been modified.

As illustrated in FIGS. 12-15, the sole structure 200*b* includes a midsole 202*b* configured to provide cushioning characteristics to the sole structure 200*b*, and one or more of the outsole members 204*b* configured to provide a ground-engaging surface 30 of the article of footwear 10*b*. As illustrated, the midsole 202*b* may include a plurality of subcomponents for providing zonal cushioning and performance characteristics. For example, the midsole 202*b* may include the primary member 206*b*, one or more secondary members or inserts 208*b*, and one or more actuation members 280*b*. While the secondary members 208*b* are generally shown and described herein as being fluid-filled bladders 208*b*, the secondary members 208*b* may have other configurations (e.g., a foam construct) within the scope of the present disclosure. Similarly, while the midsole 202*b* is generally shown and described herein as including a single bladder 208*b*, the midsole 202*b* may include more or less than one bladder 208*b* within the scope of the present disclosure.

Figure 13:
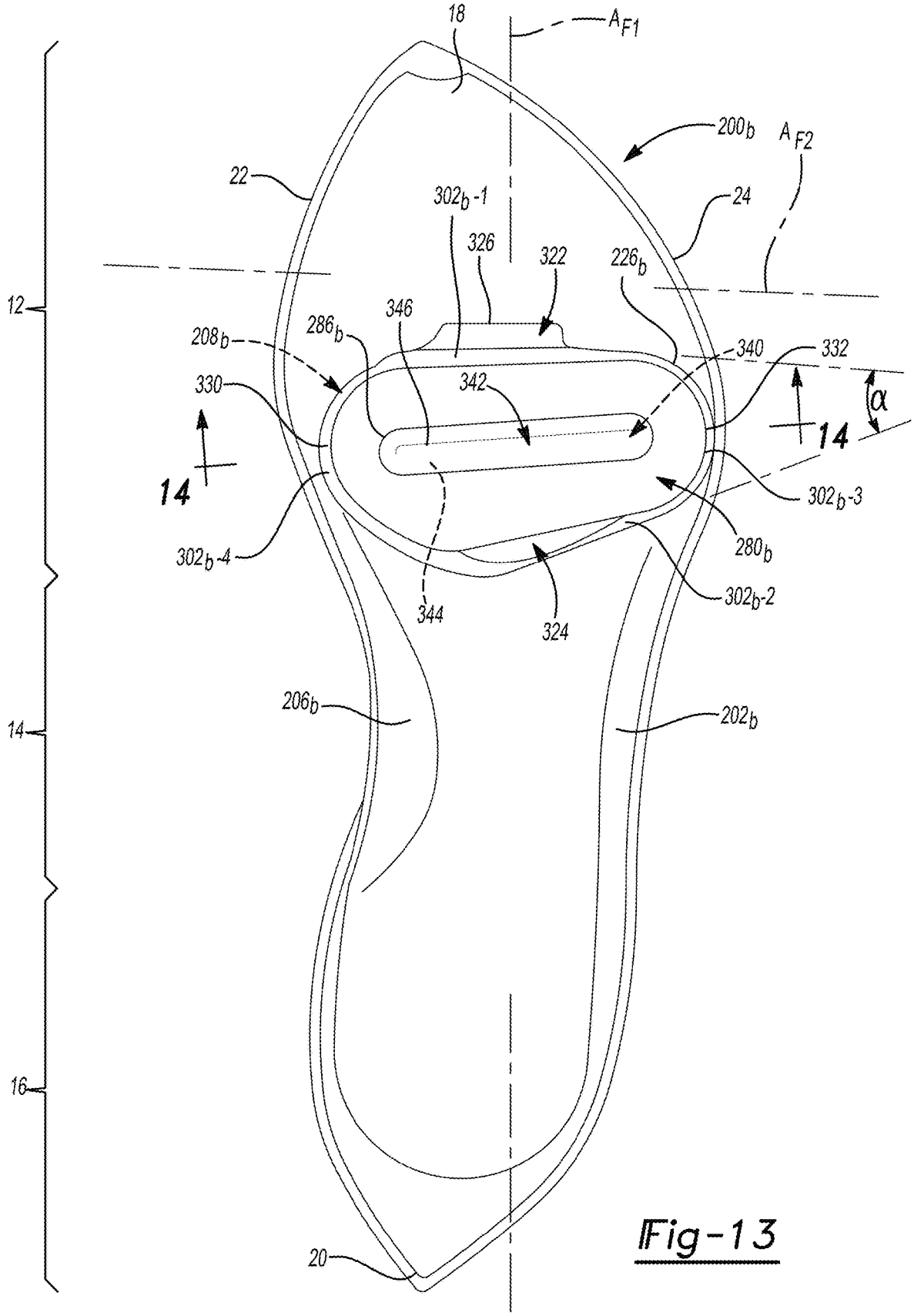
FIG. 13 is a top plan view of a sole structure of the article of footwear of FIG. 12.

The bladder 208*b* may include a first barrier layer 238*b* and a second barrier layer 240*b* opposing the first barrier layer 238*b*, which can be joined to each other at discrete locations to define a chamber 242*b* and a peripheral seam 244*b*. In some implementations, the first barrier layer 238*b* and the second barrier layer 240*b* cooperate to define a geometry (e.g., thicknesses, width, and lengths) of the chamber 242*b*. The peripheral seam 244*b* may bound the periphery of the chamber 242*b* to seal the fluid (e.g., air) within the chamber 242*b*. Thus, the chamber 242*b* is associated with an area of the bladder 208*b* where interior surfaces of the first barrier layer 238*b* and the second barrier layer 240*b* are not joined together and, thus, are separated from one another. In the illustrated example, an outer peripheral profile of the chamber 242*b* has an elongate cross-sectional shape (e.g., stadium shape), and includes a first tab 322 extending towards the anterior end 18 of the sole structure 200*b*, and a second tab 324 extending toward the posterior end 20 of the sole structure 200*b*, as best shown in FIG. 13. The first tab 324 is disposed within a recess 326 of the primary member 206*b*, and the shape of the first tab 324 corresponds to the shape of the recess 326. The outer peripheral profile of the chamber 242*b* may define various other shapes (e.g., circular, oval, rounded square, etc.) within the scope of the present disclosure.

Figure 14:
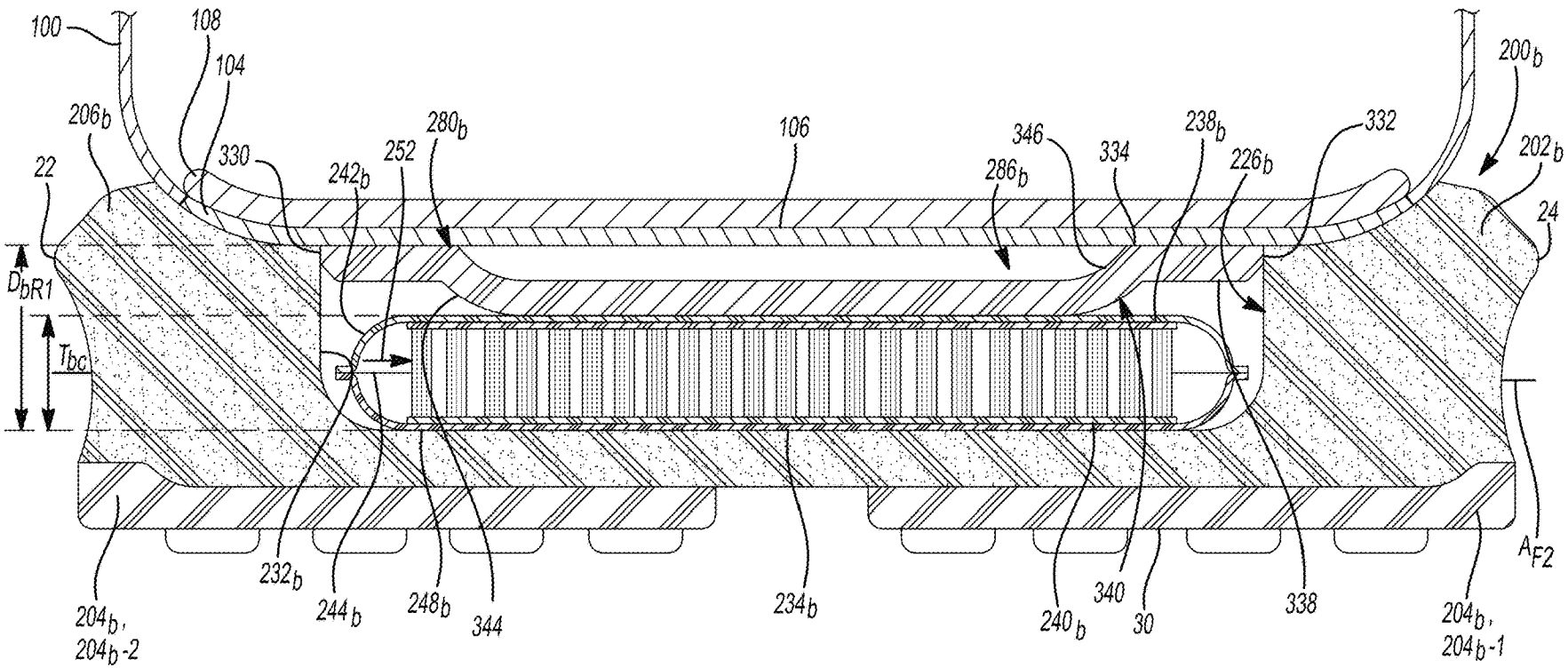
FIG. 14 is a cross-sectional view of the sole structure of FIG. 13, taken along line 14-14 of FIG. 13 corresponding to a lateral axis of the sole structure.

As shown in FIG. 14, the second barrier layer 240*b* opposes the first barrier layer 238*b* to define a thickness $Tb_C$ of the chamber 242*b* extending between opposed outer surfaces 246*b*, 248*b* of the first and second barrier layers 238*b*, 240*b*, respectively. The thickness $Tb_C$ may extend in a direction orthogonal to the outer surfaces 246*b*, 248*b*. In some implementations, the thickness $Tb_C$ is equal to the depth $Db_{R1}$ of the recess 226*b*. In other implementations, the thickness $Tb_C$ may be less than the depth $Db_{R1}$ the recess 226*b*. In the illustrated example, the first barrier layer 238*b* (e.g., the outer surface 246*b*) is cup-shaped (e.g., concave), while the second barrier layer 240*b* (e.g., the outer surface 248*b*) is substantially planar. In other implementations, one or both of the first or second barrier layer 238*b*, 240*b* (e.g., the outer surfaces 246*b*, 248*b*) is cup-shaped (e.g., concave or convex).

As shown in the figures, a space formed between opposing interior surfaces of the first barrier layer 238*b* and the second barrier layer 240*b* defines an interior void 250*b* of the chamber 242*b*. The interior void 250*b* of the chamber 242*b* may receive the tensile element 252 therein in the manner previously described.

Referring to FIG. 13, in the illustrated example, the bladder 208*b* is arranged to provide cushioning in the forefoot region 12 of the sole structure 200*b*. For example, as illustrated, the bladder 208*b* may be disposed within the recess 226*b*. In particular, the bladder 208*b* may be coupled to one or both of the peripheral surface 232*b* or the intermediate surface 234*b* using various methods of bonding, including adhesively bonding or melding, for example.

With reference to FIGS. 12 and 14, in some implementations, one or more of the outsole members 204*b*-1, 204*b*-2 . . . 204*b*-*n* may be coupled to the midsole 202*b*. For example, the outsole 204*b* and the midsole 202*b* may be assembled and secured to each other using various methods of bonding, including adhesively bonding and melding, for example. In particular, the outsole 204*b* may be overmolded onto the subcomponents 206*b*, 208*b* of the midsole 202*b*, such that the midsole 202*b* defines a profile of the ground-engaging surface 30 of the footwear 10*b*. Alternatively, the outsole 204*b* may be bonded to the midsole 202*b* using an adhesive or other suitable attachment method.

Figure 15:
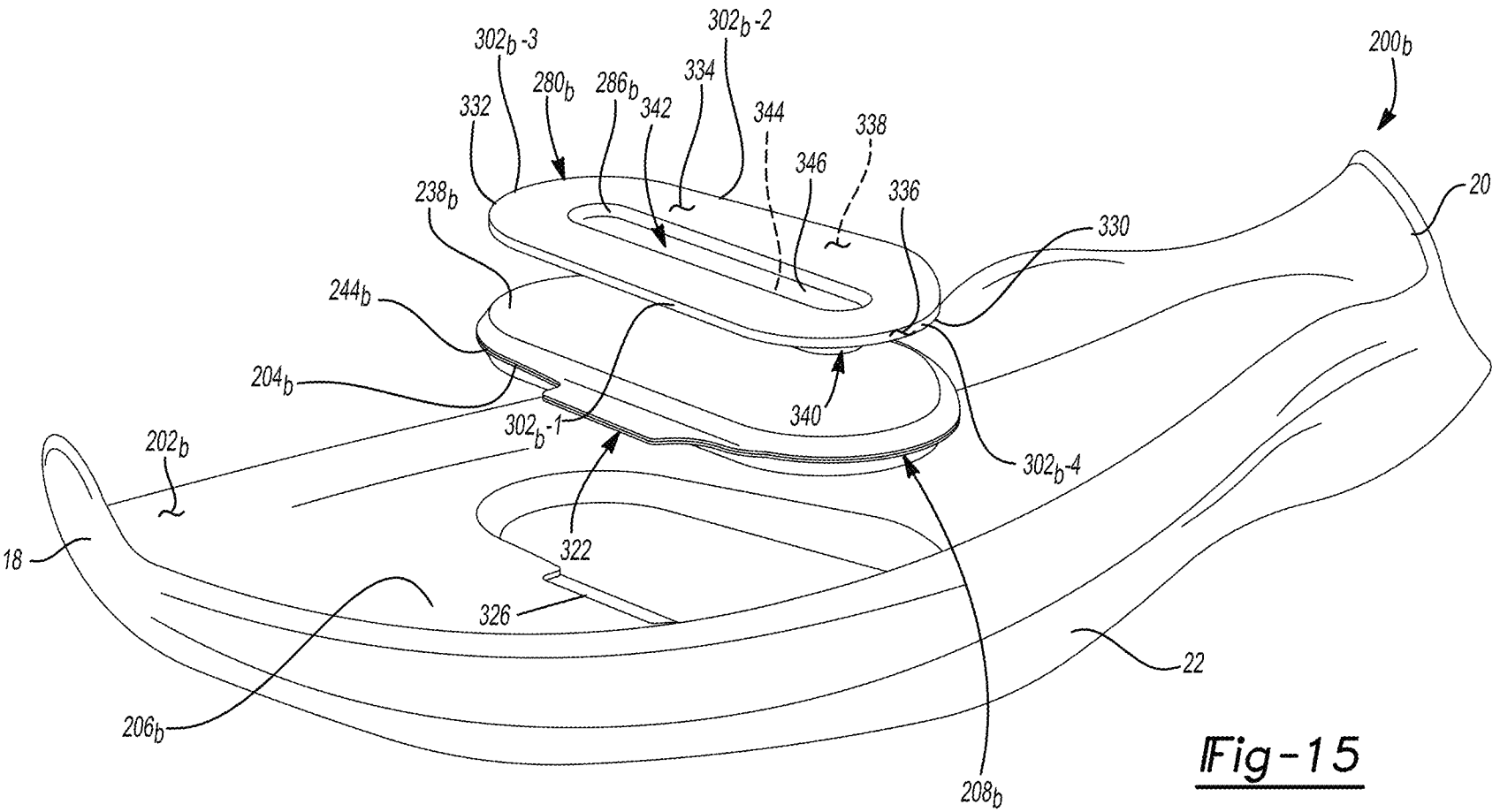
FIG. 15 is an exploded top perspective view of the sole structure of FIG. 13.

As illustrated in FIGS. 13-15, the actuation member 280*b* may include an elongated central portion 286*b* extending between a lateral side 282 and a medial side 332. The actuation member 280*b* may include an upper surface 334, a lower surface 338 opposite the upper surface 334, and a peripheral surface 336 extending from the upper surface 334 to the lower surface 338. The central portion 286*b* may include an elongated protrusion 340 extending from the lower surface 338, and a corresponding recess 342 disposed within the upper surface 334 and aligned within the protrusion 340. For example, the lower surface 338 may include a convex portion 344 corresponding to the protrusion 340, and the upper surface 334 may include a concave portion 346 aligned with the convex portion 344. As illustrated, in some implementations, the convex portion 344 and/or the concave portion 346 define an oblong (e.g., stadium or ellipse) shape.

The peripheral surface 336 may include a front segment 302*b*-1, a rear segment 302*b*-2, a lateral segment 302*b*-3, and a medial segment 302*b*-4. The front and rear segments 302*b*-1, 302*b*-2 may extend linearly and define an angle $\alpha$ therebetween. In some implementations, the angle $\alpha$ is equal to zero degrees, such that the front segment 302*b*-1 is parallel to the rear segment 302*b*-2. In other implementations, the angle $\alpha$ is greater than zero degrees (e.g., between one degree and ten degrees), such that the distance between the front and rear segments 302*b*-1, 302*b*-2 is less proximate the lateral segment 302*b*-3 than it is proximate the medial segment 302*b*-4. The lateral segment 302*b*-3 may extend arcuately from the front segment 302-1 to the rear segment 302-2, and the medial segment 302*b*-4 may extend arcuately from the front segment 302*b*-1 to the rear segment 302*b*-2.

In the assembled configuration, the central portion 286*b* may be disposed between the medial and lateral sides 22, 24 of the footwear 10*b*. In particular, the central portion 286*b* may be aligned with the longitudinal axis $A_{F2}$ of the footwear 10*b* in the assembled configuration. The actuation member 280*b* may be constructed at least in part from a flexible and/or resilient material that allows the medial side

330 to flex and move relative to the lateral side 332 during use of the footwear 10*b*. In this regard, during use of the footwear 10*b*, the cushioning and performance properties of the bladder 208*b* are effectively and efficiently imparted to the ground-engaging surface 30. Particularly, forces associated with pushing off of the forefoot during running or jumping motions may be more efficiently absorbed by the bladder 208*b*, as such forces will first be imparted onto the bladder 208*b* by the protrusion 340, effectively reducing the amount of force required to deflect the first barrier layers 238*b* of the bladder 208*b*.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A sole structure for an article of footwear having an upper, the sole structure comprising:

a midsole including a top surface and a bottom surface opposite the top surface, the top surface opposing the upper and the top surface defining a recess;

a first bladder disposed within the recess and including a first barrier element opposing the upper and a second barrier element disposed on an opposite side of the first bladder than the first barrier element; and an actuator disposed between the upper and the first bladder, the actuator including a first protrusion extending in a direction away from the upper and contacting the first barrier element of the first bladder.

2. The sole structure of claim 1, wherein the first protrusion includes a convex surface in contact with the first barrier element.

3. The sole structure of claim 2, wherein the first protrusion includes a concave surface disposed on an opposite side of the first protrusion than the convex surface, the concave surface opposing the upper.

4. The sole structure of claim 1, wherein the first protrusion is in contact with a center of the first bladder.

5. The sole structure of claim 1, further comprising an outsole attached to the bottom surface of the midsole and defining a ground-engaging surface.

6. The sole structure of claim 1, further comprising a second bladder disposed within the recess.

7. The sole structure of claim 6, wherein the second bladder is spaced apart from the first bladder.

8. The sole structure of claim 6, wherein the actuator includes a second protrusion extending in a direction away from the upper and contacting a first barrier element of the second bladder.

9. The sole structure of claim 1, wherein the first bladder is pressurized.

10. An article of footwear incorporating the sole structure of claim 1.

11. A sole structure for an article of footwear having an upper, the sole structure comprising:

a midsole including a top surface and a bottom surface opposite the top surface, the top surface opposing the upper and the top surface defining a recess;

a first bladder disposed within the recess and including a first barrier element opposing the upper and a second barrier element disposed on an opposite side of the first bladder than the first barrier element; and a first protrusion extending in a direction away from the upper and contacting the first barrier element of the first bladder to define a void between the first barrier element and the upper within the recess adjacent to the first protrusion.

12. The sole structure of claim 11, wherein the first protrusion includes a convex surface in contact with the first barrier element.

13. The sole structure of claim 12, wherein the first protrusion includes a concave surface disposed on an opposite side of the first protrusion than the convex surface, the concave surface opposing the upper.

14. The sole structure of claim 11, wherein the first protrusion is in contact with a center of the first bladder.

15. The sole structure of claim 11, further comprising an outsole attached to the bottom surface of the midsole and defining a ground-engaging surface.

16. The sole structure of claim 11, further comprising a second bladder disposed within the recess.

17. The sole structure of claim 16, wherein the second bladder is spaced apart from the first bladder.

18. The sole structure of claim 16, further comprising a second protrusion extending in a direction away from the upper and contacting a first barrier element of the second bladder.

19. The sole structure of claim 11, wherein the first bladder is pressurized.

20. An article of footwear incorporating the sole structure of claim 11.

* * * * *